United States Patent [19]

Konishi et al.

[11] Patent Number: 4,720,707

[45] Date of Patent: Jan. 19, 1988

[54] DISPLAY APPARATUS

[75] Inventors: Motofumi Konishi; Kanou Tanaka, both of Yokohama; Mitsuo Nakamura, Chofu, all of Japan

[73] Assignee: Canon Kabushiki Kaisha, Tokyo, Japan

[21] Appl. No.: 702,886

[22] Filed: Feb. 19, 1985

[30] Foreign Application Priority Data

| | | | |
|---|---|---|---|
| Feb. 24, 1984 | [JP] | Japan | 59-33621 |
| Mar. 5, 1984 | [JP] | Japan | 59-41835 |
| May 10, 1984 | [JP] | Japan | 59-93515 |

[51] Int. Cl.[4] ..... G09G 3/26

[52] U.S. Cl. ..... 340/792; 340/701; 340/721; 346/136; 346/139 A; 358/296

[58] Field of Search ..... 340/721, 724, 717, 716, 340/792, 788, 809, 810; 346/136, 134, 139 A, 44–46, 48–52, 93; 358/296, 300, 302, 301; 355/16, 54, 89, 90

[56] References Cited

U.S. PATENT DOCUMENTS

| | | | |
|---|---|---|---|
| 2,421,902 | 5/1949 | Ruth | 340/809 X |
| 3,641,266 | 2/1972 | Stults et al. | 340/717 X |
| 4,083,040 | 4/1978 | Diddons | 340/717 X |
| 4,112,423 | 9/1978 | Bertolasi | 340/717 X |
| 4,208,666 | 6/1980 | Paranjpe | 346/134 X |
| 4,547,787 | 10/1985 | Kaneko et al. | 340/792 X |
| 4,550,386 | 10/1985 | Hirosawa et al. | 340/721 X |
| 4,588,990 | 5/1986 | Tamura | 340/792 |

*Primary Examiner*—Gerald L. Brigance
*Assistant Examiner*—Jeffery A. Brier
*Attorney, Agent, or Firm*—Fitzpatrick, Cella, Harper & Scinto

[57] ABSTRACT

There is disclosed a display apparatus in which plural erasable images formed on an image bearing member are transported to display mechanism and displayed simultaneously thereon. The image bearing member moves along a determined path, along which provided are stations for image formation, display and erasure. The plural images on the image bearing member are selectively changeable.

25 Claims, 27 Drawing Figures

4,720,707

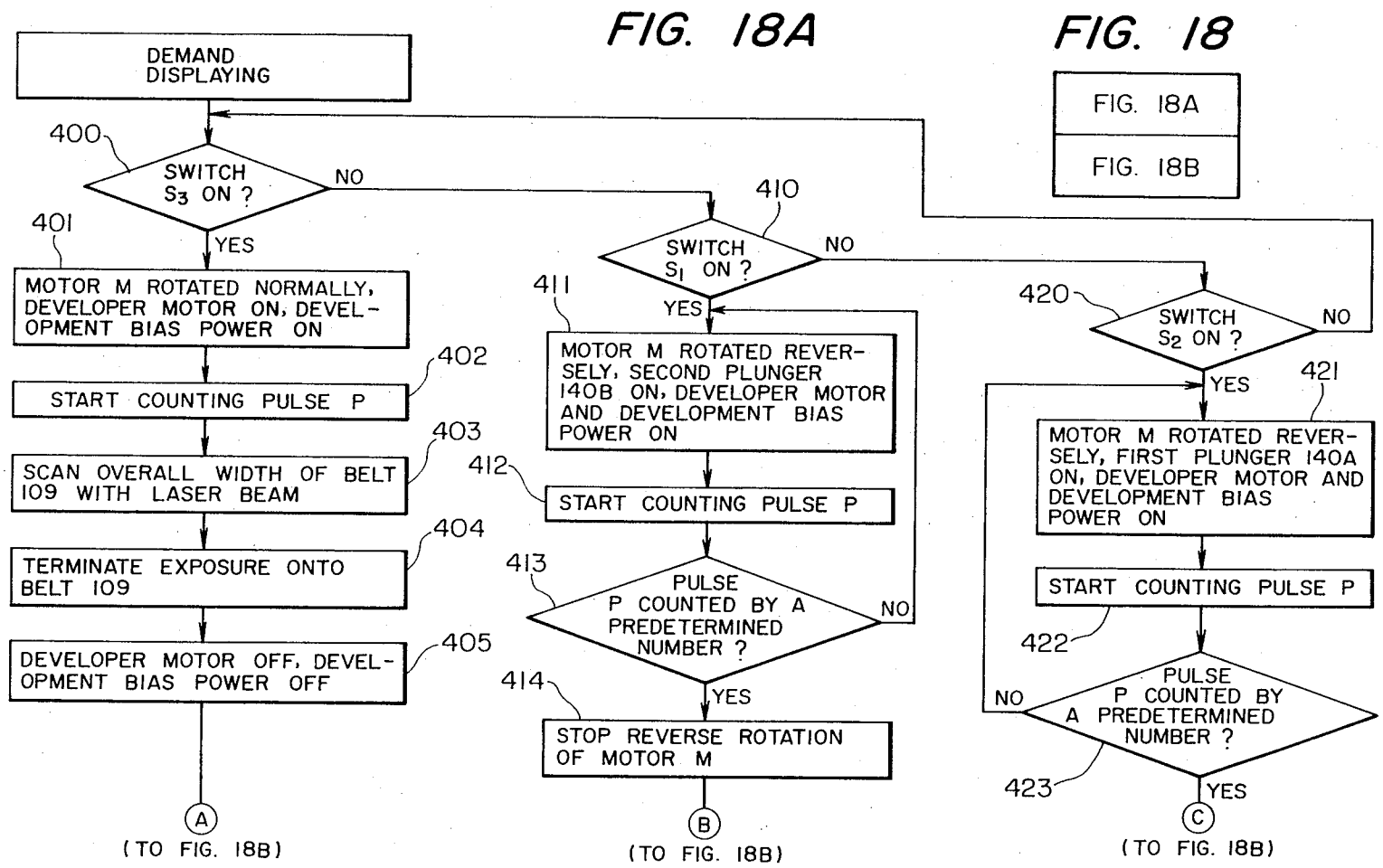
FIG. 18
FIG. 18A
FIG. 18B
DEMAND DISPLAYING
SWITCH S3 ON ?
400
NO
YES
MOTOR M ROTATED NORMALLY, DEVELOPER MOTOR ON, DEVELOPMENT BIAS POWER ON
401
START COUNTING PULSE P
402
SCAN OVERALL WIDTH OF BELT 109 WITH LASER BEAM
403
TERMINATE EXPOSURE ONTO BELT 109
404
DEVELOPER MOTOR OFF, DEVELOPMENT BIAS POWER OFF
405
(TO FIG. 18B)
SWITCH S1 ON ?
410
MOTOR M ROTATED REVERSELY, SECOND PLUNGER 140B ON, DEVELOPER MOTOR AND DEVELOPMENT BIAS POWER ON
411
START COUNTING PULSE P
412
PULSE P COUNTED BY A PREDETERMINED NUMBER ?
413
STOP REVERSE ROTATION OF MOTOR M
414
(TO FIG. 18B)
SWITCH S2 ON ?
420
MOTOR M ROTATED REVERSELY, FIRST PLUNGER 140A ON, DEVELOPER MOTOR AND DEVELOPMENT BIAS POWER ON
421
START COUNTING PULSE P
422
PULSE P COUNTED BY A PREDETERMINED NUMBER ?
423
(TO FIG. 18B)

DISPLAY APPARATUS

BACKGROUND OF THE INVENTION

1. Field of the Invention

The present invention relates to a display apparatus for displaying images formed on an image bearing member.

2. Description of the Prior Art

Cathode ray tube (Braun tube), liquid crystal display devices, etc. have conventionally been employed as an image display apparatus, for example, in the terminals for displaying as a visible image information which is supplied in the form of electrical signals from a computer or an image reader or which is accumulated in a magnetic tape or the like, or in the image monitors for use in office automation equipment such as a copier or other image-related equipment.

Among these, the cathode ray tube display apparatus is most commonly employed and is highly reliable, but is unable to display small characters or fine images in the actual size as in the newspapers or magazines due to a limitation in the resolution power. In practice an enlarged display is employed for ensuring legibility, but the number of characters displayed in the display frame, or the amount of information per frame, decreases inversely proportional to the rate of magnification. Also a prolonged continuous display of a same image results in a deterioration in the displaying ability. In addition eye fatigue is caused by the flickering of the display in prolonged use. On the other hand, the liquid crystal display, which has been recently developed, is still associated with an insufficient resolution power as in the cathode ray tube, and is difficult to be manufactured and expensive in a large size.

As a third image display apparatus not associated with the above-mentioned drawbacks, the present applicant proposed, in the Japanese Patents laid-open No. 98746-98749/1983, an image display apparatus employing an electrophotographic process. Said image display apparatus, in which the image information is displayed as a toner image, is capable of providing an easily legible image with a sufficient resolution power, is relatively inexpensive even in a large size, and is highly reliable. In the image display apparatus employing electrophotographic process, an electrophotographic photosensitive member formed for example as an endless belt is scanned with a light beam modulated by image signals to form an electrostatic latent image on said photosensitive member, then said latent image is developed with toner to obtain a toner image and the photosensitive member bearing said toner image is moved to a display station for visual observation. After the completion of display, the photosensitive member is moved to a cleaning station for removing the toner image so that the photosensitive member can be used repeatedly.

However, in such image display apparatus employing electrophotographic process, the photosensitive member constituting the display plane has to move between an image forming station and a display station in contrast to the image display system in which the display plane is fixed in a position as in the cathode ray tube, and the formed image is erased when the photosensitive member is moved. Consequently it is not possible, when the currently displayed image is related with the previously displayed image, to observe these two image at the same time.

For example, in case a patent specification and an attached drawing are given as separate images, it is necessary to display the specification first and then to move the photosensitive member for displaying the drawing to make reference between the two, and the lack of simultaneous display of the two images has been extremely inconvenient for the user.

Furthermore, several seconds are required before a new image is displayed after the observation of a preceding image, so that the observation of plural images in succession necessitates a very long time and is therefore inefficient for the user.

SUMMARY OF THE INVENTION

An object of the present invention is to provide a display apparatus capable of displaying plural images on the display station and selectively erasing those already used among said plural images.

Another object of the present invention is to provide a display apparatus capable of simultaneously displaying arbitrarily selected plural related images, and displaying succeeding images within a short time after the observation of the previously displayed images is completed.

Still another object of the present invention is to provide a display apparatus capable of rapid storage of the image to be displayed next and rapid change of the displayed image.

The foregoing objects can be achieved according to the present invention by a display apparatus which comprises image forming means for selectively forming erasable images in plural image areas of an image bearing member, display means for simultaneously displaying images formed in the plural image areas of the image bearing member, erasing means for erasing images selected among those formed in the plural image areas of the image bearing member, and transport means for transporting the image bearing member to said image forming means, display means and erasing means.

BRIEF DESCRIPTION OF THE DRAWINGS

FIGS. 18, 18A, and 18B are flow charts showing an example of the function of said control circuit;

DETAILED DESCRIPTION OF THE PREFERRED EMBODIMENTS

Now the present invention will be clarified in detail by embodiments thereof shown in the attached drawings.

Figure 1:
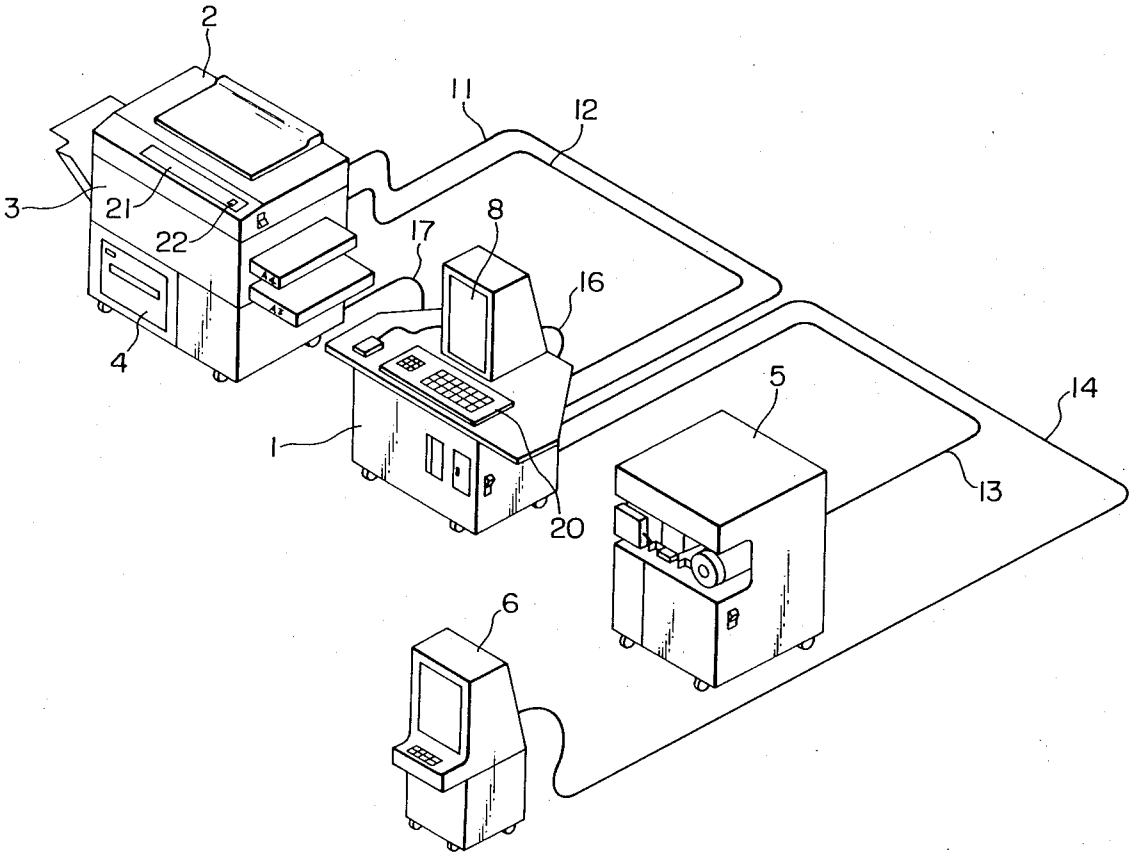
FIG. 1 is an external view of an image processing system in which the present invention is applied.

FIG. 1 is an external view of the image processing system in which the present invention is applied. A control unit 1 (hereinafter called work station) is provided with a microcomputer for system control, internal memories such as RAM and ROM, and an external memory composed of a floppy disk or a rigid disk. An input unit 2 for a digital copier converts the information of an original document placed on an original table into electrical signals by means of an image sensor such as a charge-coupled device (CCD). An output unit 3 of a digital copier is provided with a high-speed printer such as a laser beam printer for image recording on a recording material in response to information in the form of electrical signals. An image file 4 is provided with a memory medium such as an optical disk or a magnetooptical disk and is capable of recording and reading a large amount of image information. A microfilm file 5 is provided with a microfilm retrieval station and a microfilm reader station for converting the image information on the retrieved microfilm into electrical signals by means of an image sensor. A display unit 6 for displaying the image information photoelectrically read by the original reader 2 or by the image sensor of the microfilm file 5, or the image information read from the image file 4, is provided with an endless photosensitive belt having a photoconductive layer on a transparent conductive belt-shaped substrate. The photoconductive layer is exposed, through the substrate, to a laser beam modulated by the input image signals to form an electrostatic latent image corresponding to the intensity of the modulated image light on said photoconductive layer, and a thus formed latent image is developed with conductive magnetic toner or developer supported on a toner bearing member to obtain an image of a high resolution power for display. A cathode ray tube (CRT) display device 8 is used for displaying the image information photoelectrically read by the image sensor of the digital copier or the microfilm file, the image information read from the image file or the control information of the system.

There are further shown cables 11–17 for electrically connecting the various input and output units; a keyboard 20 provided on the control unit 1 for commanding the function of the system; and an operation panel 21 for commanding the function of the digital copier and equipped with keys for setting the copy number, copy magnification, etc., a copy start key 22 for instructing the start of a copying operation, a numeral display unit, etc.

Figure 2:
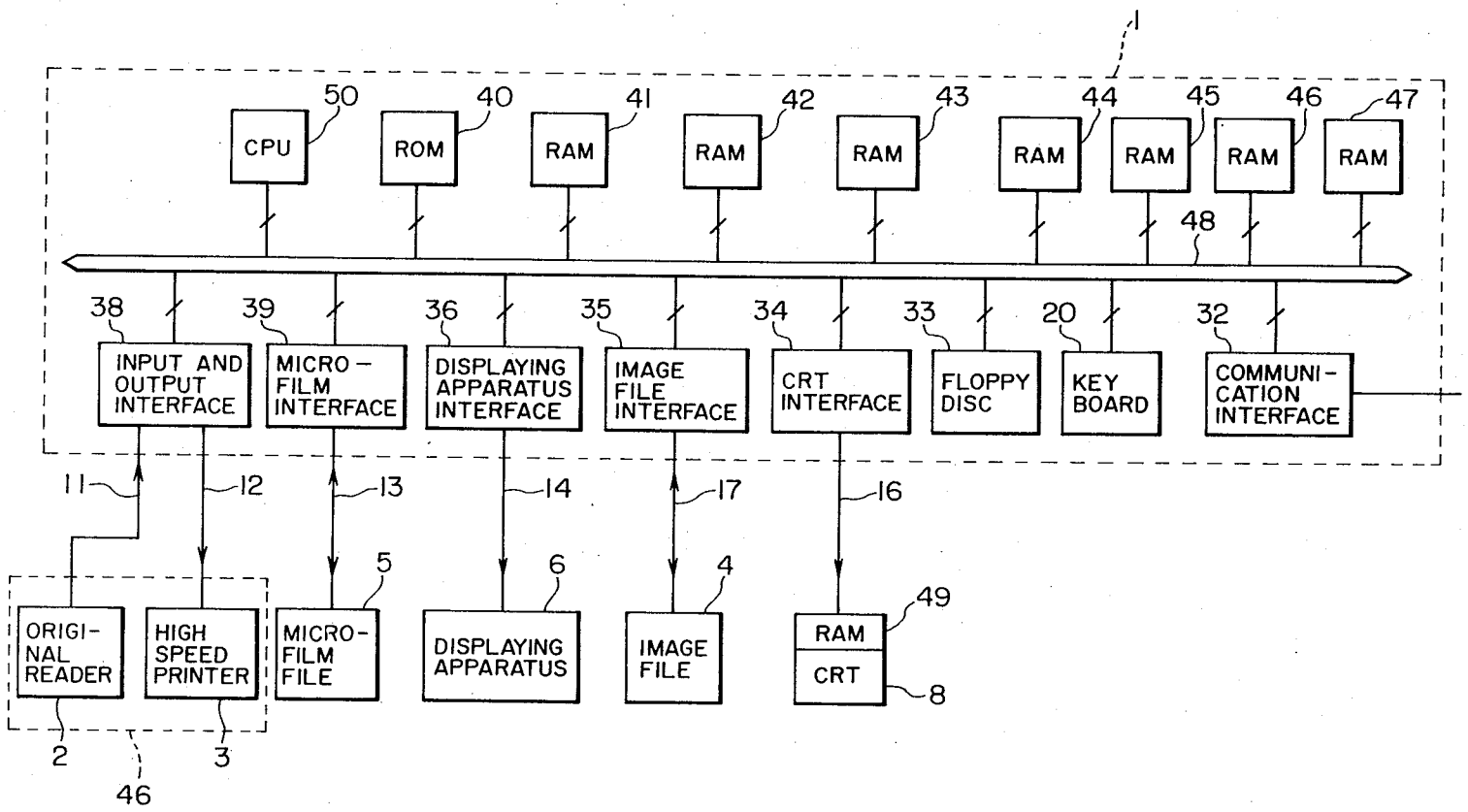
FIG. 2 is a block diagram showing the circuit structure of said image processing system.

FIG. 2 is a block diagram showing the circuit structure of the image processing system shown in FIG. 1, wherein the same blocks as those in FIG. 1 are represented by the same numbers.

The following is an explanation of the blocks in the control unit 1. A keyboard 20, also shown in FIG. 1, is used by the operator to enter instructions for the system. A communication interface 32 is used for enabling exchange of information with another similar system or a terminal through a communication channel such as a local area network. A floppy disk unit 33 is used for storing the system control program and the data base for retrieving the images from the image file.

There are further provided a CRT interface 34 for information exchange with the CRT display unit 8 for displaying the image stored in a random access memory (RAM) 49; an interface 35 for information exchange with the image file 4; an interface for information exchange with the display unit 6; an interface 39 for information exchange with the microfilm file 5; an interface for information exchange with the original reader unit 2 and the printer unit 3 constituting a digital copier 46; a central processing unit (CPU) 50 composed of a microcomputer (for example Motolora 68000); a read-only memory (ROM) 40 storing the system control program for controlling the CPU 50; a RAM 41 principally used as a working memory for the CPU 50; and page memories 42, 43, 44, 45, 46, 47 composed for example of 64K RAM's (hereinafter called RAM) for storing image signals to be exchanged among various input and output units (image signals obtained from the original reader 2, image file 4 or microfilm file 5). In the present embodiment each of six RAMs 42–47 is designed to store the information of a page, so that the image of six pages can be stored in total. A 16-bit bus 48 performs signal transmission among various blocks in the control unit 1.

The aforementioned cables 11–17 electrically connect the various input and output units and are used for transmitting control and image signals. The illustrated arrows indicate the direction of flow of image signals. The flow of the control signals in the cables is bidirectional.

Since the image signals to or from the original reader 2, printer 3, microfilm file 5 and display unit 6 are serial, the input/output interface 38 is provided with a serial-to-parallel (16 bit) converting register for image signal input and a parallel (16 bit)-to-serial converting register for image signal output. Also the microfilm interface 39 is provided with a serial-to-parallel (16 bit) converting register, and the display interface 36 is provided with a parallel (16 bit)-to-serial converting register.

In the following there will be explained the flow of image signals.

A first area of the display unit 6 is used for displaying the image of a page selected from the images of three pages stored in the RAMs 42, 43, 44, while a second area of the display unit 6 is used for displaying the image of a page selected from the images of three pages stored in the RAMs 45, 46, 47. Thus the display unit 6 can simultaneously display two mutually related images. For example it is rendered possible to observe an explanation and a related drawing by displaying said explanation in the first area of the display unit 6 and said drawing in the second area thereof. The selection of the images to be stored in the RAMs 42, 43, 44, 45, 46, 47 is made by the keyboard or by keys provided in the display unit 6.

Figure 3:
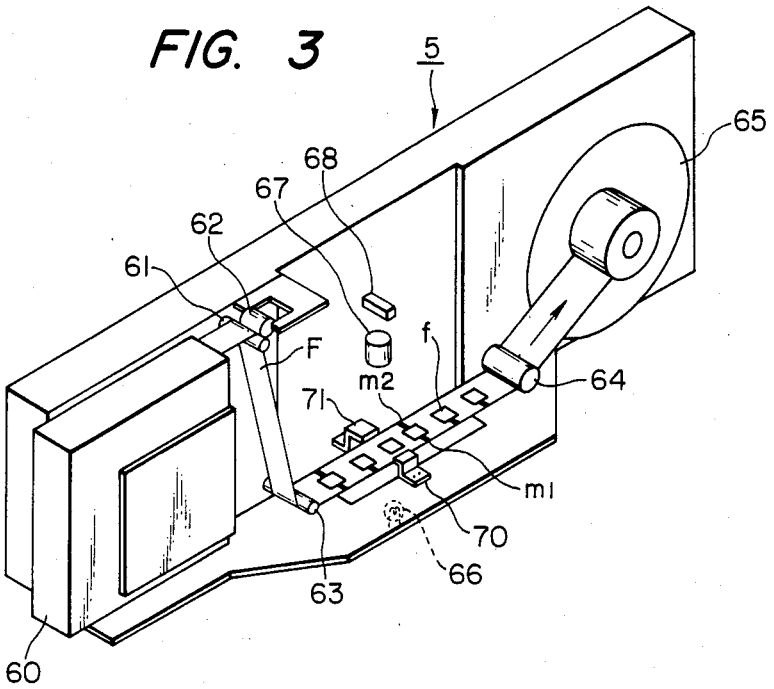
FIG. 3 is a schematic perspective view of a microfilm file.

FIG. 3 shows an embodiment of the microfilm file 5, in which a microfilm F is contained in a cartridge 60, supplied therefrom by a capstan roller 61 and a pinch roller 62, advanced by a represented guide rail and guide rollers 63, 64 and taken up on a take-up reel 65.

The microfilm F is provided with plural frames f recording patent specifications in the order of pages, a frame mark m1 positioned at the edge portion below each frame, and a case mark m2 positioned at the upper edge portion indicating the first frame of each patent specification. The microfilm F is illuminated by a lamp 66 at a determined position, whereby the information of the illuminated frame is focused by a lens 67 onto a linear image sensor 68 composed for example of a charge-coupled device (CCD), which thus reads the information of the image of a page. There are also provided a frame detector 70 for detecting the frame mark m1, and a case mark detector 71 for detecting the case mark m2.

The frame mark m1 and the case mark m2 have a density different from that in the surrounding area and intercept the light to the frame mark detector 70 and the case mark detector 71 when said marks on the microfilm pass between the lamp 66 and said detectors 70, 71, whereby a mark signal is generated by the corresponding detector. The information of a desired case can be retrieved by counting, with a counter, the case mark signal generated by the case mark detector 71 upon detection of the case mark, and the information of each frame can be retrieved by counting, with a counter, the frame mark signal generated by the frame mark detector 70 upon detection of the frame mark. The details of the retrieving device will not be explained as they are already known in the Japanese Patent Laid-open No. 54428/1981. Although the microfilm contains a number of pages of image information, the desired information can be selected by the retrieving function incorporated in the control unit 1.

The image sensor 68 performs a relative movement to the microfilm when desired information is retrieved and brought to a determined illuminating position, and the image of a page (a frame) is read in the form of electrical signals by a main scanning by said image sensor and a subsidiary scanning by said relative movement. The obtained image signals (video signals) are stored, through the microfilm interface 39, in one of the RAMs 42, 43, 44, 45, 46, 47.

As an example, first, second and third pages of the description of a patent specification are respectively stored in the RAMs 42, 43, 44, and first, second and third pages of attached drawings are respectively stored in the RAMs 45, 46, 47.

The first area of the display unit 6 displays one of the images stored in the RAMs 42–44. As an example, in case the second page of the description is displayed in the first area of the display unit and an instruction is given to display the image of the third or first page of the description, the image of the second page of the description is erased and the image of the third or first page of the description is displayed in the first area of the display unit. The abovedescribed sequence of image input/output causes alternate display of the pages preceding and succeeding the previously displayed image. In case an instruction is given to display the image of the third page, the image of a fourth page of the description is read and stored in a RAM where the image of the first page has been stored.

The second area of the display unit displays one of the images stored in the RAMs 45–47. As an example, in case the second page of the drawings is displayed in the second area of the display unit and, after said displayed image is observed in conjunction with the image simultaneously displayed in the first area of the display unit 6, an instruction is given to display the third or first page of the drawings, the image of the second page is erased and the image of the third or first page of the drawings is displayed in the second area of the display unit. In this manner the second area of the display unit functions in the same manner as the first area thereof.

Figure 4:
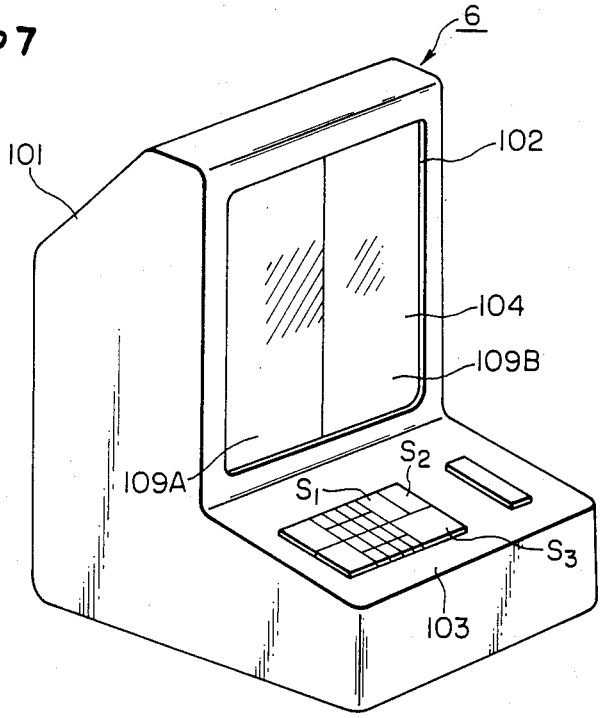
FIG. 4 is a perspective view of a display apparatus.
Figure 5:
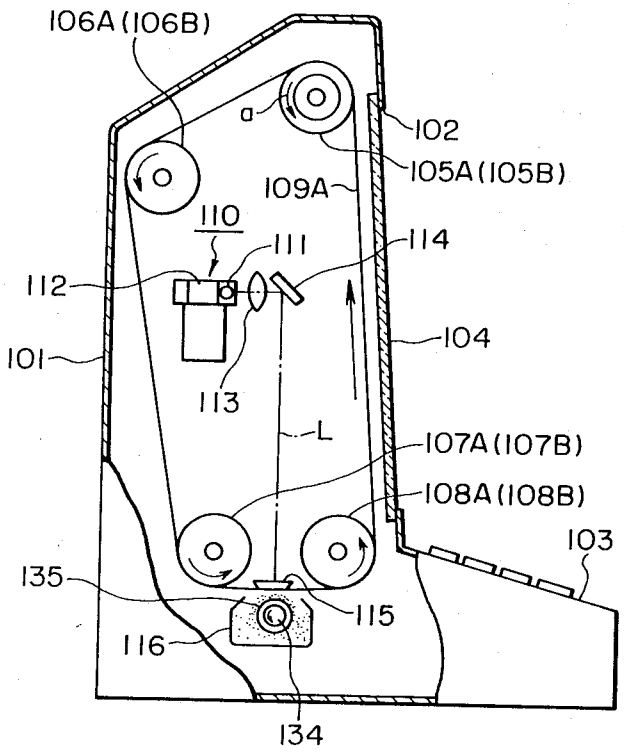
FIG. 5 is a cross-sectional view of the display apparatus.

FIGS. 4 and 5 are respectively an external perspective view and a longitudinal cross-sectional view of the display unit 6 having an image bearing member for image display, wherein shown are a vertically oblong casing 101; a displayed image viewing aperture 102 formed in a front panel of the casing; an operation panel 103 provided on a projecting lower part of the front panel; a display glass screen 104 provided in the aperture 102; and four sets of rollers 105A (105B), 106A (106B), 107A (107B), 108A (108B) for supporting the endless photosensitive belts, of which two sets are positioned at the upper part of the casing 101 while other two sets are positioned at the lower part thereof, all rotatably supported in mutually parallel manner and in pairs at left and right in said casing.

Figure 6:
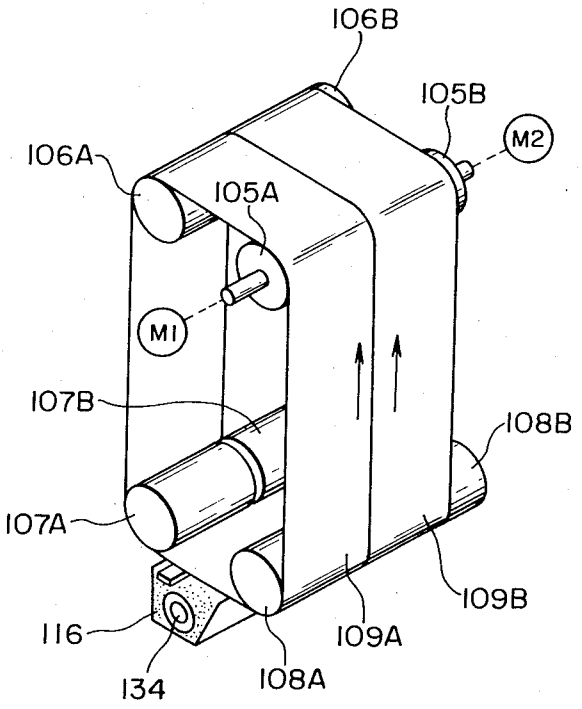
FIG. 6 is a perspective view showing structure of a belt.

FIG. 6 shows the state of supporting endless photosensitive or recording members, constituting the image bearing member, by means of the aforementioned rollers, wherein a first endless photosensitive belt 109A is supported by the rollers 105A, 106A, 107A, 108A while a second endless photosensitive belt 109B is supported by the rollers 105B, 106B, 107B, 108B positioned side by side to the rollers 105A–108A, and both photosensitive belts 109A, 109B are positioned perpendicular to the moving direction thereof. It is to be noted that the photosensitive members need not be endless.

Said endless photosensitive belt 109A or 109B (hereinafter simply called belt) is composed of a transparent sheet substrate such as a polyester sheet, a thin evaporated metal layer provided on the external surface thereof to attain electroconductivity while substantially retaining the transparency, and a photosensitive (photoconductive) layer for example of CdS formed on said evaporated metal layer. Said belt is therefore flexible and is supported by the above-mentioned four rollers, with the photosensitive layer positioned outside.

Among said rollers 105A–108A, 105B–108B, the rollers 105A and 105B are used as driving rollers. Said rollers are respectively linked with first and second motors M1, M2, which are independently driven to respectively drive the first and second belts 109A, 109B in mutually independent manner. At least a set of other rollers, for example the rollers 106A, 106B, is used as tension rollers for providing the belts 109A, 109B with a suitable tension. Thus, by driving the driving rollers 105A (105B) anticlockwise in FIG. 5 by the motor M1 (M2), the belt 109A (109B) is accordingly rotated anticlockwise without waving, slack or slippage, whereby the external surface of said belt 109A (109B) passes upwards through the viewing aperture 102 between the rollers 105A (105B) and 108A (108B).

A laser beam scanning image exposure device 110, positioned in a space inside the belts 109A, 109B is composed of a semiconductor laser 111, a polygonal mirror scanner 112, an f-$\theta$ imaging lens 113, a mirror 114 and a transparent plate 115. Said transparent plate 115 is composed of a laterally oblong glass or plastic plate maintained in contact, under a suitable pressure, with the internal surface of the belts between the rollers 107A, 107B and 108A, 108B.

In said image exposure device 110, the semiconductor laser 111 emits a laser beam L, modulated by time-sequential image signals supplied from the original reader 2, microfilm file 5 or image file 4, towards the polygonal mirror scanner 112, which deflects said laser beam L in the direction transverse to the belts to scan, through the f-$\theta$ lens 113, mirror 114 and transparent plate 115, the internal surface of the belts positioned between the rollers 107A, 107B and 108A, 108B. In this manner an image exposure, by the laser beam from the inside of the belt, is achieved by the main scanning with said laser beam and by the subsidiary scanning by the rotary movement of the belt 109A or 109B. Also said image exposure device may be composed for example of a light-emitting diode array for emitting light information.

A toner developing device 116, positioned outside the belts between the rollers 107A, 107B and 108A, 108B, has a developing area equal to or wider than the sum of the widths of two belts 109A, 109B, whereby the latent images on said belts can be developed in a single developing device 116. The transparent plate 115 is positioned slightly lower than the joint lower tangent line of the rollers 107A, 107B and 108A, 108B whereby it is pressed against the internal surface of the belts 109A, 109B.

Figure 7:
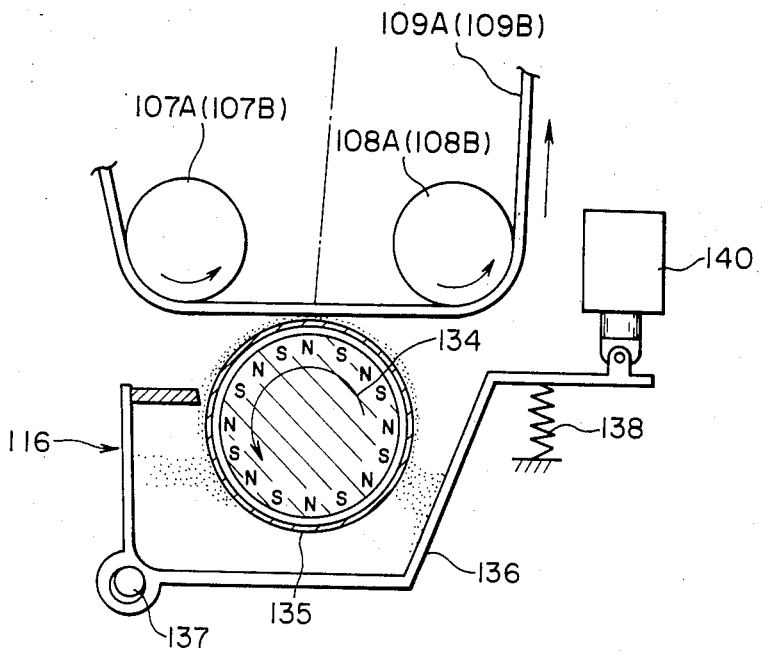
FIG. 7 is a cross-sectional view of a developing station.

FIG. 7 shows the details of the developing device 116, wherein a sleeve 135 is positioned in a developer container 136 and is provided therein with magnets 134 rotated in a direction of the arrow by a developer motor not shown. The container 136 is rotatably supported by a shaft 137 and is biased in the clockwise direction by a spring 138. The container 136 is connected to a plunger 140, whereby the sleeve 135 is separable from the belt, thus not effecting image development, when said plunger 140 is deactivated. When the plunger 140 is energized, the container 136 rotates counterclockwise to bring the sleeve 135 closer to the belts 109A, 109B, thus enabling development of the electrostatic latent images with the toner. A DC bias voltage is applied across the sleeve 135 and the conductive layer of the belts 109A, 109B.

In the present invention, however, the rotary motion of the developing device 116 is not essential and is merely employed for preventing the smear of the photosensitive belts with the toner when the apparatus is left unused for a prolonged period. The developing device is not limited to the magnetic brush developing device explained above but may be replaced by other known developing devices employing for example fur brush development or cascade development.

The laser beam scanning image exposure device 110 shown in FIG. 5 can scan either the entire width of the belts 109A and 109B or a half width thereof. Thus two images are recorded when the entire width of two belts is scanned by the laser beam, and an image is recorded either on the first belt 109A or the second belt 109B if said first belt 109A or second belt 109B alone is scanned. It is also possible to provide two exposure devices corresponding to the belts 109A, 109B, respectively. The first belt 109A and the second belt 109B respectively correspond to the first and second areas of the display unit.

In the following there will be explained the image formation, display and image erasure in the above-described display unit.

At first initial data setting, such as retrieval of image information, designation of image display position etc. is made by the keys on the operation panel 103, and a display start instruction is entered by a key, whereby the plunger 140 is energized and the motors M1, M2 are activated in the forward direction at the same speed to rotate the photosensitive belts 109A, 109B at a determined speed in the direction indicated by arrow. Then the exposure by the laser beam scanning is started, according to the selected image information, on the internal surface of the belts 109A, 109B between the rollers 107A, 107B and 108A, 108B, thus simultaneously forming two images. At the same time the developing device 116 treats the external surfaces of the belts with toner to form toner images in succession, corresponding to the exposures, on the external surfaces of the belts 109A, 109B. When two toner images formed on the external surfaces of the belts are brought to the viewing aperture by the rotary motion of the belts, the belts 109A, 109B are simultaneously stopped. At the same time the plunger 140 is deactivated to move the developing device 116 away from the belts 109A, 109B to a non-developing position. In this manner two images are displayed in the aperture 102 and can be viewed through the glass 104. Then, in response to a belt restart instruction, the motor M1 or M2 is activated in the forward direction to move the belt 109A or 109B again in the direction indicated by the arrow to display the next image at the aperture. The toner image on the external surface of the belt is erased, after display, by cleaning action of the developing brush in the developing device 116, and a new toner image formation is effected immediately thereafter by an exposure simultaneous with the image development.

As explained above, the developing device functions also as cleaning means. Since the image information is displayed as a toner image formed with a very fine laser beam L, it is rendered possible to provide a clear and easily legible display even for small characters or fine patterns. Also the use of toner deposition simultaneous with the exposure provides a relatively inexpensive display unit even for a large frame size, with corona chargers or particular cleaning means. Further, the display unit thus obtained is substantially free from mechanical failures or deterioration in the photosensitive member and is therefore highly reliable.

Figure 8:
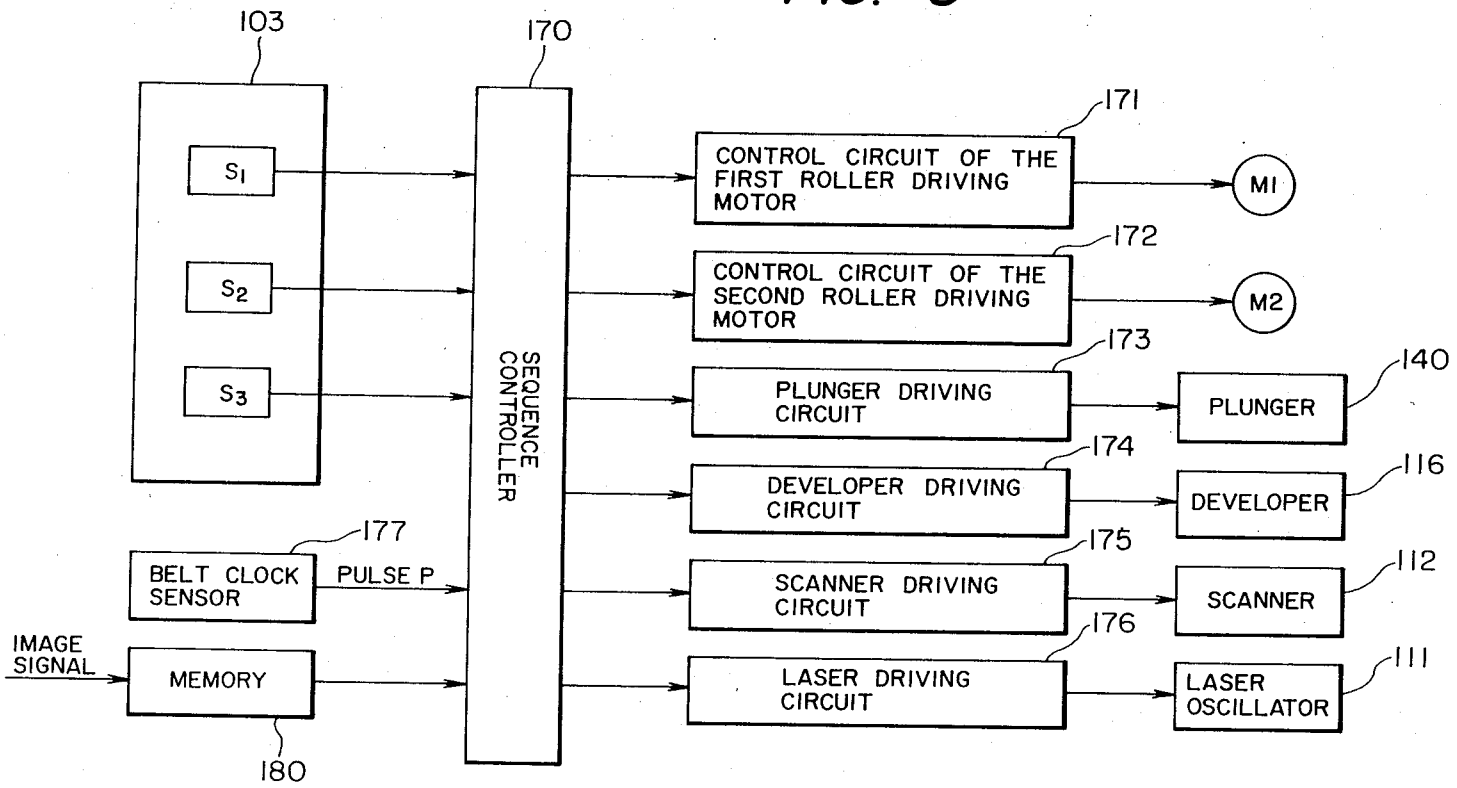
FIG. 8 is a block diagram of a control circuit of the display apparatus.

FIG. 8 shows an embodiment of the control circuit of the display unit shown in FIG. 4, wherein a sequence controller 170 identifies the instructions of the operator in response to the input signals from the operation panel 103 and controls the instructed function. The signals supplied from the operation panel 103 are supplied through the sequence controller 170 and the display interface 36 to the CPU 50, which controls the RAMs 42–47, image file 4 and microfilm file 5 in response to said signals. The operation panel 103 is provided with a switch S1 for selecting image formation on the first belt 109A, a switch S2 for selecting image formation on the second belt 109B, and a switch S3 for selecting two image formations on the first and second belts 109A, 109B. Said switch S1 is used to erase an image on the first belt 109A and to form a new image thereon, while the switch S2 is used to erase an image on the second belt 109B and to form a new image thereon, and the switch S3 is used to erase images on the first and second belts 109A, 109B and to form new images thereon. There are also shown a control circuit 171 for the first motor M1 for rotating the roller 105A for the first belt 109A; a control circuit 172 for the second motor M2 for rotating the roller 105B for the second belt 109B; a driving circuit 173 for the plunger 140; a developer driving circuit 174 for activating the motor of the developing device 116 and supplying a DC developing bias voltage of +200 to +300 V thereto; a driving circuit 175 for activating the scanner 112; and a driving circuit 176 for activating the laser 111. A belt clock sensor 177, composed for example of photoencoders directly mounted on the shafts of the driving rollers 105A, 105B, generate a pulse P in response to the rotation of the driving roller 105A or 105B by a determined angle, or of the belt 109A or 109B by a determined distance. The pulse P is generated by the photoencoder mounted on the roller 105A in case the motor M1 alone is activated, or by that mounted on the roller 105B in case the motor M2 alone is activated, and is generated by either photoencoder in case both motors are activated.

The sequence controller 170 measures the amount of movement of the belts by counting said pulses and thus controls the movement of said belts.

The scanner driving circuit 175 activates the scanner 112 for causing scanning motion of the laser beam in the main scanning direction. The laser driving circuit 176 controls the laser 111 to modulate the laser beam in response to the image signals and to turn off the laser beam in the non-image area in the main scanning direction. The sequence controller 170 generates a blanking signal for scanning the first belt 109A alone when the switch S1 is actuated, or a blanking signal for scanning the second belt 109B alone when the switch S2 is actuated, or an unblanking signal for scanning both the first and second belts 109A, 109B when the switch S3 is actuated, and said signals are supplied to the laser driving circuit. Also when the switch S1 is actuated, the first motor control circuit 71 activates the first motor M1 to move the belt 109A in a direction indicated in FIG. 3.

Simultaneously the plunger driving circuit 173 energizes the plunger 140 to bring the developing device 116 to the developing position. On the other hand, when the switch S2 is actuated, the second motor control circuit 172 activates the second motor M2 to move the second belt 109B in the direction indicated by the arrow.

Simultaneously the plunger driving circuit 173 energizes the plunger 140 to bring the developing device 116 to the developing position. A buffer memory 180, corresponding to the RAMs 42–47 shown in FIG. 2, stores the image (video) signals supplied for example from the original document reader 2. The memory capacity of said buffer memory can be of one or several lines in case the moving speed of the belts 109A, 109B is synchronized with the image reading speed in the subsidiary scanning direction of the original reader 2 etc., or has to be of one or two pages in case said speeds are mutually unsynchronized. Said capacity can be of one page in case an image is independently formed on the belt 109A or 109B, and has to be of two pages in case images are simultaneously formed on said belts.

Figure 9:
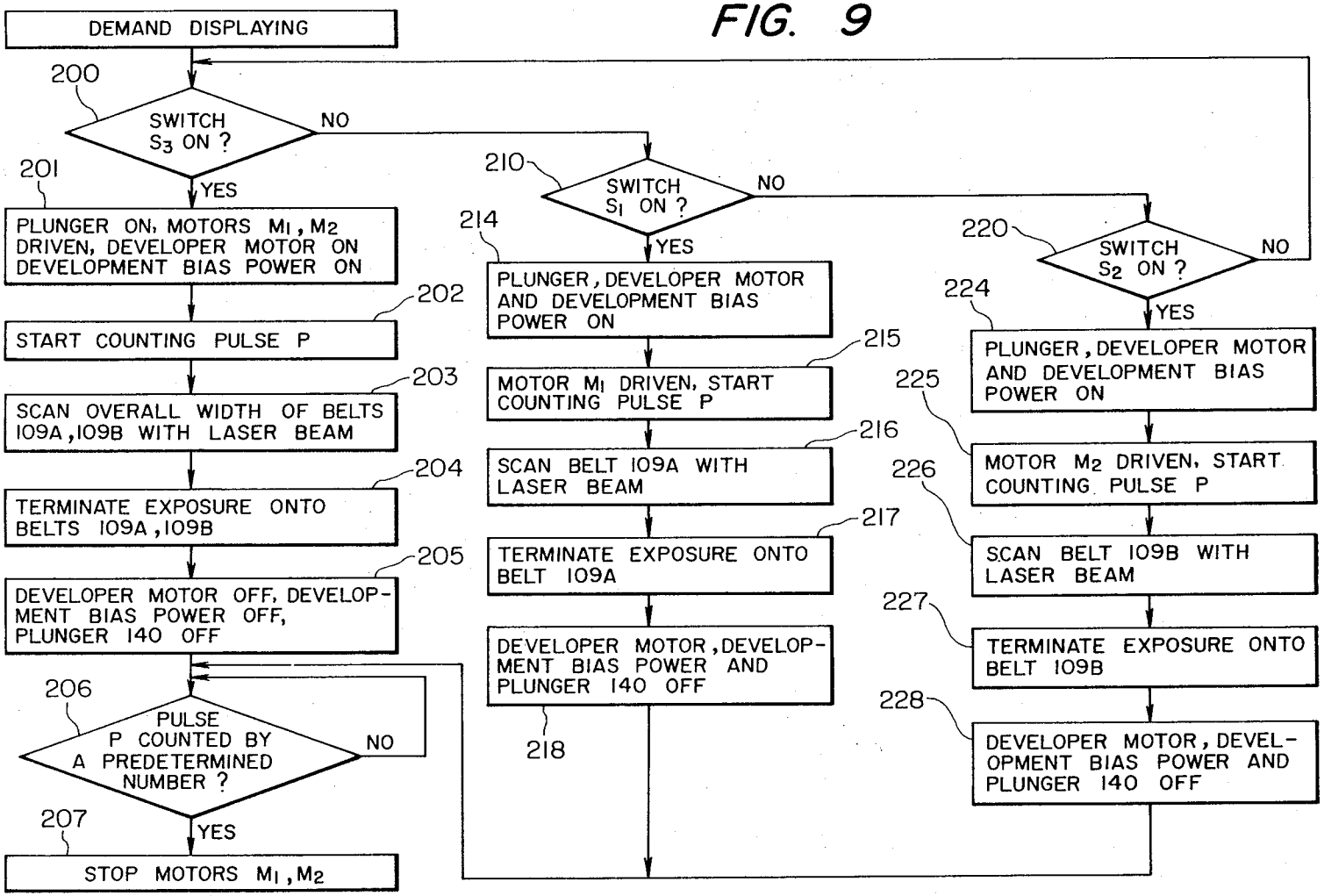
FIG. 9 is a flow chart showing an example of the function of said control circuit.

FIG. 9 shows the sequence of functions in the apparatus shown in FIG. 8 in response to an image display instruction. At first the operator instructs the retrieval of two images to be displayed through the operation panel 103 and actuates the switch S3 (step 200). In response the plunger 140 is energized and the motors M1, M2 are activated to rotate the rollers 105A, 105B in a direction a to move the belts 109A, 109B. Also the developing motor is activated to rotate the magnets 134, and the developing bias voltage is applied to the developing device 116 (step 201). In this state the plunger 140 is turned on, and the developing device 116 is placed in the developing position. In response to the rotation of the belts 109A, 109B, the pulses P are counted (step 202), and the laser beam scans the entire scanning range of the belts 109 (step 203). The laser beam is modulated by the image signals of a page stored in a first area of the memory 180 when scanning the first belt 109A, and is modulated by the image signals of a page stored in a second area of the memory 180 when scanning the second belt 109B.

Upon completion of signal recording of two images onto the belts 109A, 109B (step 204), the developing motor is stopped when the trailing edge of the exposed areas on the belts 109A, 109B passes the developing position, and the developing bias voltage is simultaneously turned off (step 205). Then the plunger 140 is deactivated to move the developing device 116 to the non-developing position. When the pulse count reaches a determined value (step 206), the motors M1, M2 are simultaneously stopped (step 207) to stop the belts 109A, 109B. In this state the two images formed on the belts 109A, 109B are positioned in the aperture 102, thus enabling simultaneous observation for the operator.

Figure 10:
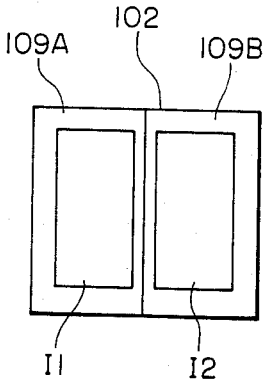
FIG. 10 is a schematic view showing an image displayed in the display station.

FIG. 10 shows the state of displayed images, wherein a first image I1 formed on the first belt 109A and a second image I2 formed on the second belt 109B can be simultaneously observed on the display unit. If said first image I1 is the image of the first page of a patent specification describing FIG. 1, and said second image I2 is the image of said FIG. 1, it is rendered possible for the operator to read the description while making reference to the corresponding illustration.

In case of changing the first image I1 to the image of the second page of said patent specification without changing the second image I2, the image to be displayed by the first belt 109A (image of the second page) is designated by the operation panel 103, and the switch S1 is actuated (step 210), whereby the plunger 140 is energized (step 214). Thus the developing device 116 moves to the developing position. Then the motor M1 is activated (step 215), and the laser beam scans the belt 109A alone (step 216) to record a new image thereon. Said laser beam is modulated, during the scanning of the belt 109A, by the image signals of the second page stored in the memory 180. The first image I1 on the first belt 109A is moved in the direction indicated by the arrow, and, upon arrival at the developing device 116, removed by the cleaning function of the developing brush, and a new toner image is formed immediately thereafter by an exposure simultaneous with an image development.

After the recording of the image signals onto the first belt 109A is completed, and, in response to the passing of the trailing edge of the exposed area of said first belt 109A through the developing position, the developing motor, developing bias voltage and plunger 140 are turned off (step 218), and the motor M1 is stopped thereafter through steps 206 and 207. When the motor M1 is stopped, there are displayed, in the aperture 102, a first image showing the second page of the patent specification and a second image showing FIG. 1 of said patent specification previously displayed, so that the operator can simultaneously observe the altered first image on the first belt and the second image on the second belt which has been displayed without change. Then, in case of changing the second image to the image of FIG. 2 of the patent specification without changing the first image, the operator designates an image to be displayed on the second belt 109B and actuates the switch S2 (step 220), whereby the plunger 140 is energized (step 224). Thus the developing device 116 is moved to the developing position.

Subsequently the motor M2 is activated (step 225), and the laser beam scans the second belt 109B alone (step 226). In said scanning the laser beam is modulated by the image signals corresponding to FIG. 2 of the patent specification, stored in the memory 180.

After the recording of image signals onto the second belt 109B is completed (step 227), and, in response to the passing of the trailing edge of the exposed area of the second belt 109B through the developing position, the developing motor, developing bias voltage and plunger 140 are turned off (step 228). Thereafter the motor M2 is stopped through the steps 206 and 207. When the motor M2 is stopped, there are displayed, in the aperture 102, a first image showing the previously displayed second page of the patent specification and a second image showing FIG. 2 of said patent specification, so that the operator can simultaneously observe the altered second image and the unaltered first image.

The switch S3 is to be actuated in case of erasing and changing both images I1, I2.

In the following there will be explained a case of observing plural images in succession. Assuming that a first image I1 formed on the first belt 109A and a second image I2 formed on the second belt 109B are simultaneously displayed in the aperture 102 as shown in FIG. 10, the user at first observes the first image I1 on the first belt 109A, and then observes the second image I2 on the second belt 109B. When the observation of the first image I1 is completed, the switch S1 is actuated to display a succeeding image, whereby the first motor M1 is activated to move the first belt 109A and to record a new image thereon. In this manner, during the observation of the second image I2 on the second belt 109B, a new image is formed on the first belt 109A and displayed in the aperture 102, so that the user can observe said new image on the first belt 109A immediately after the observation of the second image I2 on the second belt 109B. When the observation of the second image I2 is completed, the switch S2 is actuated. Thus, by actuating the switch S1 or S2 upon completion of observation of an image, a succeeding image can be prepared while another image is observed in the aperture, and plural images can be efficiently observed within a short time.

In the foregoing embodiment there are employed two belts to obtain a display as shown in FIG. 10, it is also possible to employ three or more belts. Also the belts may be driven bidirectionally instead of movement in only one direction.

Figure 11:
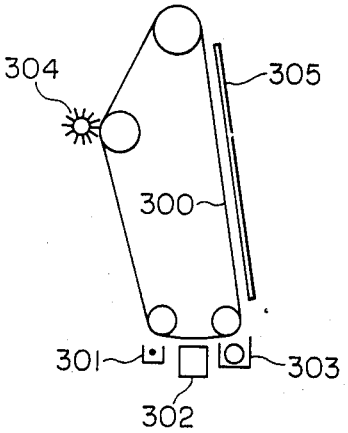
FIGS. 11 to 14 are schematic views showing other embodiments of the display apparatus.

FIG. 11 shows another embodiment of the present invention, in which there are provided, along each of plural photosensitive belts 300 each having a conductive layer and a photoconductive layer in the already known manner, a charger 301, an image exposure station 302, a developing station 303, a cleaning station 304 containing for example a fur brush, and an observing aperture or window 305.

A similar effect as explained before can be obtained by arranging plural photosensitive belts 300 in parallel manner perpendicular to the moving direction of said belts, and by independently driving said belts. Each belt is associated with charging, exposure, developing and cleaning stations for independent image formation and erasure for each belt.

The present invention is not limited to the foregoing embodiments but is applicable to any apparatus in which an erasable image is formed on a belt-shaped movable image bearing member. Such other embodiments are shown in FIGS. 12 and 13.

Figure 12:
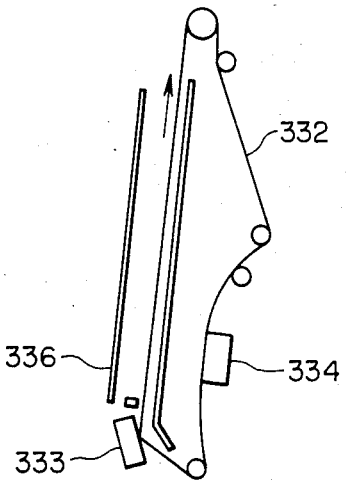

In an image display apparatus shown in FIG. 12, visible images are formed by thermal heads 333 on plural reversible recording belts 332 showing thermal color change for example with $Ag_2HgI_4$, and are erased by cooling with cooling units 334. 336 is an observing window composed of a transparent glass plate. The thermal head 333 heats the recording belt 332 in response to the image signals to form a visible image by color change.

Figure 13:
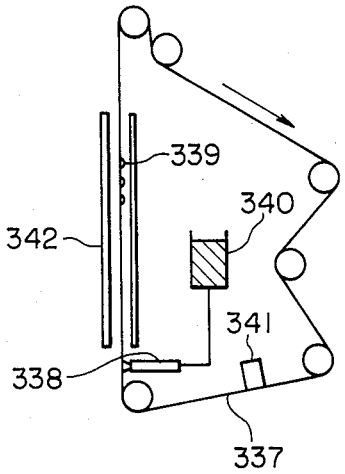

In an image display apparatus shown in FIG. 13, transparent liquid droplets 339 are deposited by droplet emitting means (ink jet) 338 onto plural recording belts 337 having a diffusing layer at the back side, thereby forming a visible image by the light transmitted by said liquid droplets. There are also shown a tank 340 containing said transparent liquid, a cleaning unit 341 for wiping the liquid droplets from the recording belts, and a display window 342.

Furthermore the present invention is applicable to a system in which a latent image is formed by magnetic multi-stylus electrodes and is developed with toner on an image bearing member composed of a dielectric belt, and is erased by the removal of said toner.

It is furthermore possible to form and display an image over two belts 109A, 109B, then move a belt 109A or 109B to erase the image thereon and form and display a new image thereon, thus showing an edited image composed of a partial image newly formed on said belt and another partial image which has been formed on the other belt. In this manner a partial modification or a partial erasure can be made on a part of the displayed image.

As explained in the foregoing, the display apparatus of the present invention provides for simultaneous arbitrary observation of selected plural images, to erasure of only the images that have become no longer necessary, and alteration of the images within a short time. Also it is possible to erase a part of the displayed image, to form a new image in the erased area and to display said new image together with the unerased image to provide an edited image.

Figure 14:
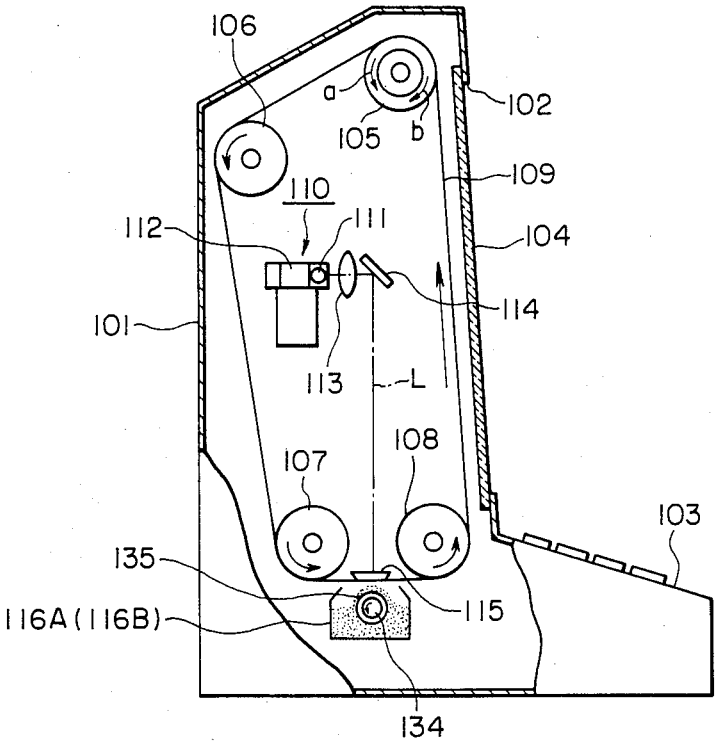

FIG. 14 shows still another embodiment of the display apparatus of the present invention, wherein the same components as those in the foregoing embodiments are represented by the same numbers. In the embodiment shown in FIG. 14, a casing 101 contains a photosensitive belt 109, which is supported by four rollers 105–108. The belt 109 is constructed in the same manner as the aforementioned belts 109A, 109B.

Among said four rollers 105–108, the roller 105 is used as a driving roller driven by an unrepresented motor M. At least one of other three rollers 106–108, for example the roller 106, functions as a tension roller to provide the belt 109 with a suitable tension. Thus, in response to counterclockwise rotation of the driving roller 105 by the motor M, the belt 109 is moved counterclockwise without waving, slack or slippage, whereby the external surface of the belt 109 passes upwards through a display aperture or window 102, positioned between the rollers 105 and 108.

Developing units 116A, 116B are arranged side by side, outside the belt between the rollers 107 and 108. A transparent plate 115 is positioned slightly below a common lower tangent line of the rollers 107, 108 so as to be in pressure contact with the internal surface of the belt 109.

Figure 15:
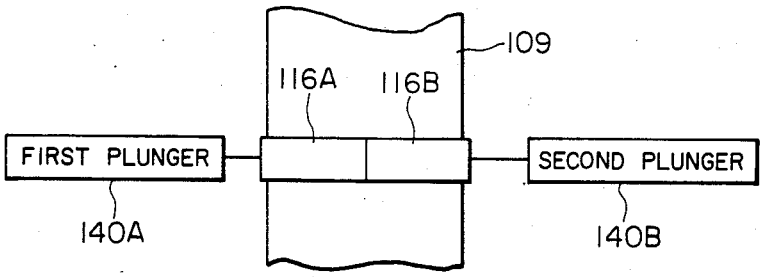
FIG. 15 is a schematic view showing the relation between the belt and the developing station in the apparatus shown in FIG. 14.

FIG. 15 shows the positional relationship between the belt 109 and the developing units 116A, 116B, wherein the first developing unit 116A faces a left-hand first area of the belt 109, while the second developing unit 116B faces a right-hand second area of the belt 109. Each of the developing units 116A, 116B is movable between a developing position close to the belt 109 and a non-developing position separated from the belt 109, and the first developing unit 116A is linked to a first solenoid plunger 140A while the second developing unit 116B is linked to a second solenoid plunger 140B. Each developing unit is provided with a sleeve 135 internally containing magnets 134 which are rotated, in a direction indicated by an arrow, by an unrepresented developer motor.

Figure 16:
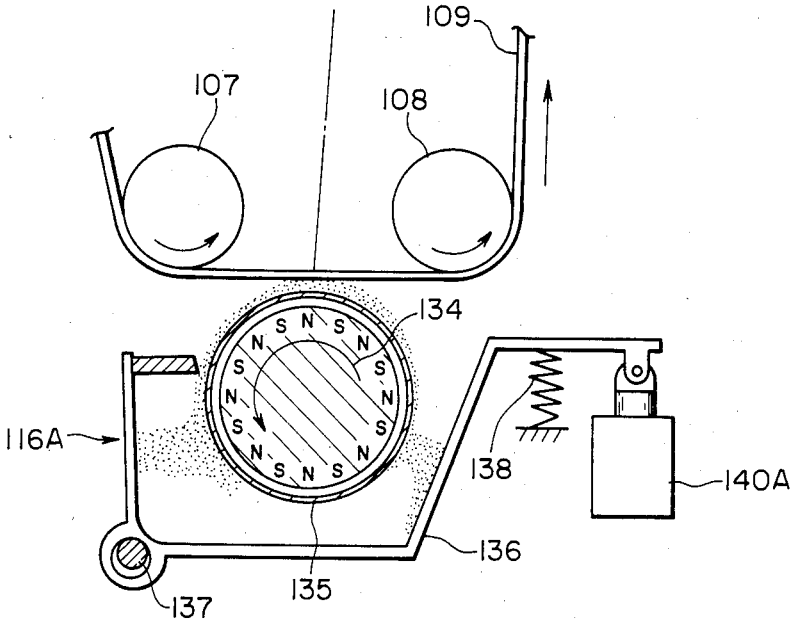
FIG. 16 is a cross-sectional view of a developing station in the apparatus shown in FIG. 14.

FIG. 16 shows a moving mechanism of the developing unit, wherein shown are a container 136 of the first developing unit 116A; a shaft 137 rotatably supporting the container 136, and a spring 138 for biasing the container 136 in the counter-clockwise direction about the shaft 137. When the first plunger 140A, shown in FIG. 15 and linked to the container 136 is energized, the container 136 rotates clockwise, whereby the sleeve 135 becomes separated from the belt 109 and the first developing unit 116A is brought to a non-developing position. On the other hand, when the first plunger 140A is deactivated, the spring 138 rotates the container 136 counterclockwise, whereby the sleeve 135 comes closer to the belt 109 and can develop an electrostatic latent image on the left-hand area of the belt with toner. A DC developing bias voltage is applied across the sleeve 135 and a conductive layer of the belt 109. The second developing unit 116B is constructed in the same manner as the first developing unit 116A, and is brought to the non-developing position when the second plunger 140B is energized, or is brought to the developing position when the second plunger 140B is deactivated, thus developing an electrostatic latent image on the right-hand half of the belt with toner.

The laser beam exposure unit 110 shown in FIG. 14 can either scan the entire width of the belt or a half width thereof and records two images in the scanning of the entire width. Also in the scanning of the left-hand half of the belt (no scanning in the right-hand half) there is recorded a first image in said left-hand half, and in the scanning of the right-hand half of the belt (no scanning in the left-hand half) there is recorded a second image in said right-hand half.

In the following there will be explained the image formation, display and erasure functions of the above-described display apparatus.

At first initial data setting, such as retrieval of image information, designation of image display position etc. is made by the keys on the operation panel 103, and a display start instruction is entered by a key, whereby the motor M is activated in the forward direction to drive the photosensitive belt 109 at a predetermined speed in the direction indicated by the arrow. Then the exposure by the laser beam scanning is started, according to the selected image information, on the internal surface of the belt 109 positioned between the rollers 107, 108. At the same time the developing units 116A, 116B treat the external surface of the belt with toner to form toner images in succession, corresponding to the exposure, on the external surface of the belt 109. When two toner images formed on the external surface of the belt are brought to the viewing aperture 102 by the rotary motion of said belt, said belt 109 is temporarily stopped. In this manner two images are displayed in the window 102 and can be observed through the glass 104. Then, in response to a belt re-start instruction, the motor M is activated in the forward direction to move the belt 109 again in the direction of arrow to display the next image at the window. The toner image on the external surface of the belt is erased, after display, by the cleaning function of the developing brush in the developing units 116A, 116B, and a new toner image formation is effected immediately thereafter by an exposure simultaneous with the image development. When the developing units are in the non-developing position, the toner image on the belt is not subjected to a cleaning operation and are, therefore, not erased. In this manner said developing units function also as cleaning means.

FIG. 14 shows an embodiment of the control circuit of the display apparatus shown in FIG. 14, wherein a sequence controller 170 identifies the instructions of the operator in response to the input signals from the operation panel 103 and controls the instructed function. The operation panel 103 is provided with a switch S1 for selecting image formation on the left-hand half of the belt, a switch S2 for selecting image formation on the right-hand half, and a switch S3 for selecting two side-by-side image formations on the belt. Said switch S1 is used to erase an image in the left-hand half of the belt and form a new image in said half without affecting the image formed in the right-hand half, while the switch S2 is used to erase the image in the right-hand half of the belt and to form a new image in said half, without affecting the image present in the left-hand half, and the switch S3 is used to erase the images at both the left and right and to form new images in the thus erased areas.

There are also shown a control circuit 171 for the reversible motor M for rotating the roller 105 for driving the belt 109; a driving circuit 172 for the first plunger 140A; a driving circuit 173 for the second plunger 140B; a developer driving circuit 174 for driving the developing motors of the developing units 116A, 116B and supplying a DC developing bias voltage of +200 to +300 V thereto; a driving circuit 175 for the scanner 112; a driving circuit 176 for the laser 176; and a belt clock sensor 177 composed for example of a photoencoder directly mounted on the shaft of the driving roller 105 and adapted to generate a pulse P for each rotation of the roller 105 by a predetermined angle, i.e. for each movement of the belt 109 by a predetermined length. The sequence controller 170 measures the amount of movement of said belt by counting said pulses and accordingly controls the movement of said belt.

The scanner driving circuit 175 activates the scanner 112 for deflecting the laser beam from the laser unit 111 into the main scanning direction. The laser driving circuit 176 controls the laser unit 111 to modulate the laser beam in response to the image signals and to turn off the laser beam in the non-image area in the main scanning direction. The sequence controller 170 generates a blanking signal for scanning the left-hand half of the belt 109 only when the switch S1 is actuated, or a blanking signal for scanning the right-hand half of the belt 109 only when the switch S2 is actuated, or an unblanking signal for scanning both the left- and right-hand halves of the belt 109 when the switch S3 is actuated, and said signals are supplied to the laser driving circuit. Also when the switch S2 is actuated, the first plunger driving circuit 172 energizes the first plunger 140A to maintain the first developing unit 116A in the non-developing position for a predetermined period. When the switch S1 is actuated, the second plunger driving circuit 173 energizes the second plunger 140B to maintain the second developing unit 140B in the non-developing position for a predetermined period.

A memory 180 stores at least two frames (pages) of the image signals (video signals) supplied from the original reader 2 etc.

Figure 17:
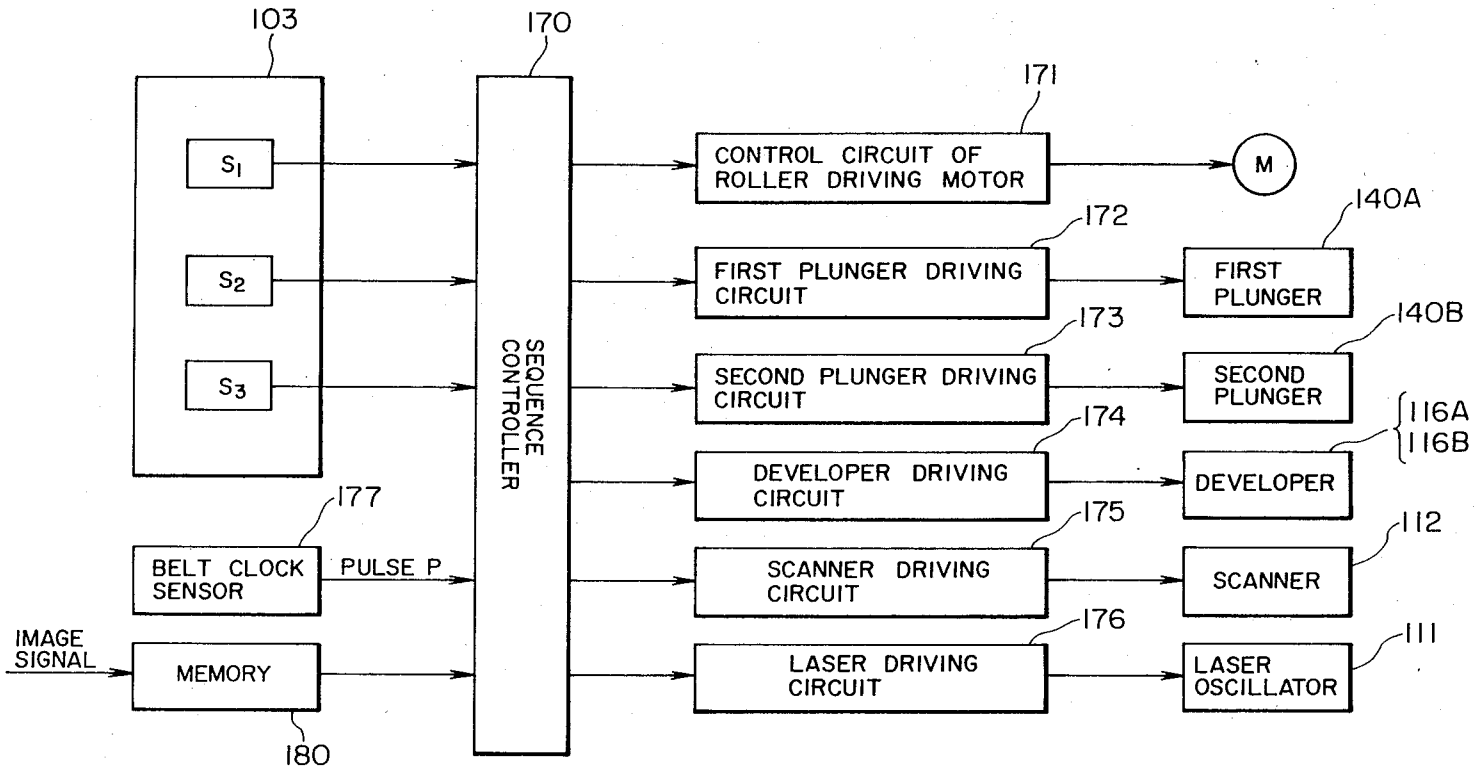
FIG. 17 is a block diagram of a control circuit of the apparatus shown in FIG. 14.
Figure 18B:
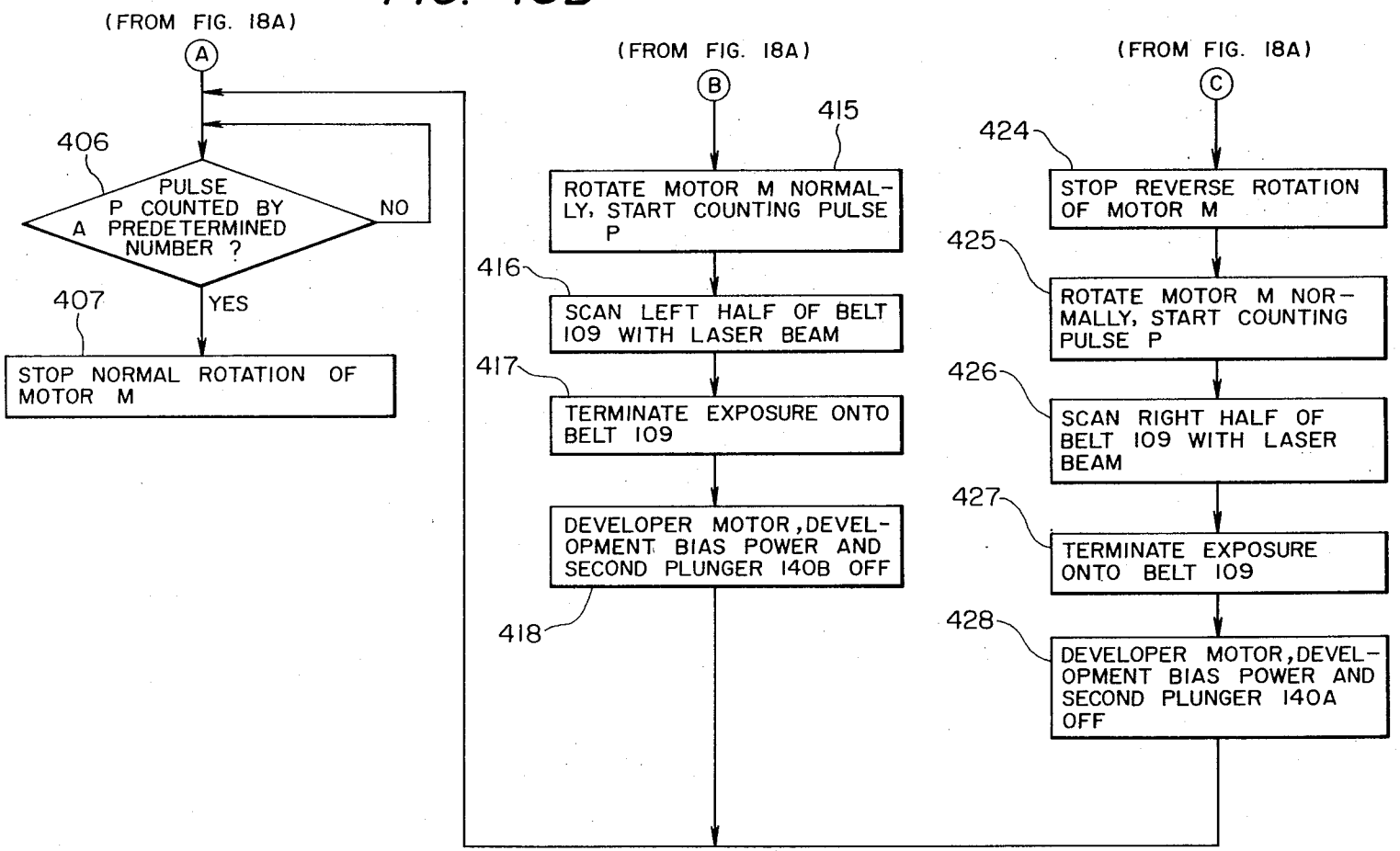

FIGS. 18, 18A, 18B show the sequence of functions of the display apparatus shown in FIG. 17, in response to an image display instruction. At first the operator instructs the retrieval of two images to be displayed through the operation panel 103, and actuates the switch S3 (step 400). In response the motor M is activated in the forward direction to rotate the roller 105 in a direction a to move the belt 109. Also the developer motors are activated to rotate the magnets 134, and the developing bias voltage is supplied to the developing units 116A, 116B (step 401). In this state the first and second plungers 140A, 140B are deactivated to maintain the developing units 116A, 116B in the developing position. In response to the rotation of the belt 109, there are started the counting of the pulses P (step 402), and the entire main scanning range of the belt 109 is scanned by the laser beam (step 403). The laser beam is modulated by the image signals of a page stored in a first area of the memory 180 in scanning the left-hand half of the belt 109, and by the image signals of another page stored in a second area of the memory 180 in scanning the right-hand half of the belt 109.

When the recording of the image signals of two images onto the belt 109 is completed (step 404), the developer motors are turned off upon the passing of the trailing enge of the exposed area of the belt 109 through the developing position, and the developing bias voltage is turned off (step 405). Then, when the count of the pulses P reaches a predetermined value (step 406), the motor M is stopped (step 407) to terminate the movement of the belt 109. In this state the two images formed thereon are positioned at the display window 102 so that the operator can observe said images with mutual reference.

Figure 19:
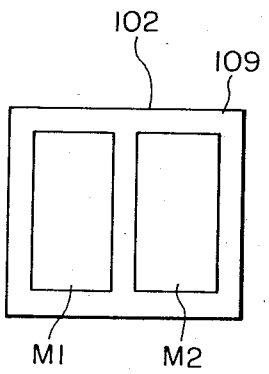

FIG. 19 shows the state of displayed images. The operator can simultaneously observe a first image M1 formed on the left-hand half of the belt 109 and a second image M2 formed on the right-hand half of the belt 109 in the display window. If said first image M1 is the image of the first page of a patent specification describing FIG. 1, and said second image M2 is the image of said FIG. 1, it is rendered possible for the operator to read the description while making reference to the corresponding illustration.

In case of changing the first image M1 to the image of the second page of said patent specification without changing the second image M2, the image to be displayed on the left-hand half of the belt 109 (image of the second page) is designated by the operation panel 103, and the switch S1 is actuated (step 410), whereby the motor M is reversed to rotate the roller 105 in a direction b thus moving the belt 109 in the reverse direction, and the plunger 140B is energized (step 411). Thus the second developing unit 116B moves to the non-developing position. The second image M2 formed on the right-hand half of the belt 109 is not erased during the passage between the exposure unit 111 and the second developing unit 116B. At the start of reverse movement of the belt 109 there is started the counting of the pulses P (step 412), and, when the count thereof reaches a predetermined value (step 413) the motor M is stopped (step 414). In this state the leading edge of the second image M2 on the belt 109 is placed behind the position for exposure and development (left to the developing unit in FIG. 14). Then the motor M is activated in the forward direction (step 415) and the laser beam scans the left-hand half of the belt 109 where the first image M1 was formed (step 416) to form a new image therein. In scanning the left-hand half of the belt, the laser beam is modulated by the image signals of the second page stored in the memory 180. The first image M1 on the belt is removed by the developing brush in the first developing unit 116A in the course of movement of the belt in the direction of the arrow, and a new toner image is formed immediately thereafter by the new exposure simultaneous with image development.

When the recording of the image signals onto the left-hand half of the belt 109 is completed (step 417), the developer motor, developing bias voltage and second plunger 140B are turned off upon passing of the trailing edge of the exposed area of the belt 109 through the developing position (step 418), and the forward rotation of the motor M is then stopped through the steps 406, 407. In this state the display window 102 displays a first image showing the second page of the patent specification and a second image of previously displayed FIG. 1, so that the operator can simultaneously observe the altered first image and the unaltered second image.

In case of thereafter changing the second image to an image showing FIG. 2 of said patent specification without changing the first image, the operator designates an image to be displayed on the right-hand half of the belt 109 and actuates the switch S2 (step 420). In response the motor M is reversed, and the first plunger 140A is energized (step 421), whereby the first developing unit 116A is shifted to the non-developing position. Thus the first image formed on the left-hand half of the belt 109 is not erased.

At the start of the reverse motion of the belt 109 there is started the counting of the pulses P (step 422), and, when the count of the pulses P reaches a predetermined value (step 423), the motor M is stopped (step 424). In this state the second image M2 on the belt is entirely erased, and the leading edge of the first image is placed behind the position for exposure and development (left to the developing unit in FIG. 14). Then the motor M rotates in the forward direction (step 425), and the laser beam scans the right-hand half of the belt 109, where the second image M2 was erased (step 426). Said laser beam is modulated by the image signals of FIG. 2 of said patent specification stored in the memory 180, in scanning said right-hand half of the belt.

When the recording of the image signals onto the right-hand half of the belt 109 is completed (step 427), the developer motor, developing bias voltage and first plunger 140A are turned off upon the passing of the trailing edge of the exposed area of the belt 109 through the developing position (step 428), and the motor M is stopped through the steps 406, 407. In this state the display window 102 displays a first image showing the second page of the patent specification and a second image showing FIG. 2 of said specification, so that the operator can simultaneously observe the altered second image and the unaltered first image. The switch S3 is to be actuated in case of changing both the first and second images M1, M2.

It is also possible to display an image over the entire display area, i.e. over the left- and right-hand halves of the belt and to achieve image editing by a partial replacement, a partial erasure or an addition of the displayed image by erasing the left- or right-hand half of said displayed image and forming a new image in the thus erased area.

In the foregoing embodiment there are displayed two images in the display window, but it is also possible to display three or more images. In such case there are arranged three or more developing units (eventually with cleaning means) in the transversal direction of the belts. Also instead of a lateral array of two images, the images may be arranged in the vertical direction as shown in FIG. 20.

Figure 20:
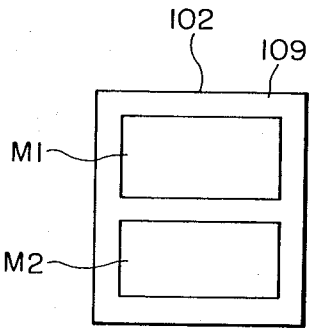
FIGS. 19 and 20 are schematic views showing images displayed in the display station.

In case of FIG. 20, two images M1, M2 are positioned vertically on the belt 109 for simultaneous observation in the display window. Only one developing unit is required for image formation as shown in FIG. 20. In this case the developing unit has a width corresponding to the width of the belt, and moves between a developing position and a non-developing position by means of a plunger. The developing unit is so controlled as to be in the developing position when an image to be erased or a latent image to be developed passes through the developing position, and in the non-developing position when an image not to be erased passes through said developing position. In this case the exposure unit 111 always scans the entire main scanning range of the belt.

Figure 21:
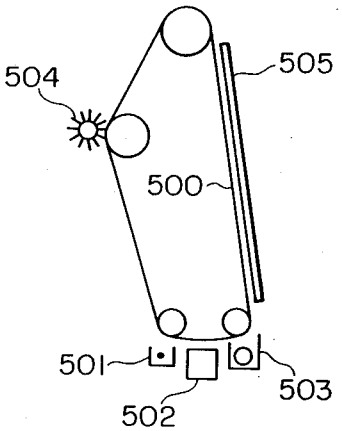
FIG. 21 is a schematic view showing another embodiment of the display apparatus.

FIG. 21 shows still another embodiment of the present invention, in which there are provided, along a known electrophotographic photosensitive belt 500, a charger 501; an exposure unit 502; a developing station 503; and a cleaning station 504 utilizing for example fur brush, wherein the developing station 503 is movable between a developing position and a non-developing position, and the cleaning station 504 is movable between a cleaning position and a non-cleaning position. In the direction transverse to the belt there are provided plural cleaning units 504 which are selectively movable between the cleaning position and the non-cleaning position. Similarly the developing station 503 is composed of plural developing units as shown in FIG. 15, which are selectively movable between the developing and non-developing positions.

In the embodiment shown in FIG. 14, the motor M is reversed in case of erasing either one of two images, but it is also possible to drive the motor M only in the forward direction to move the belt 109 always in the same direction.

Figure 22:
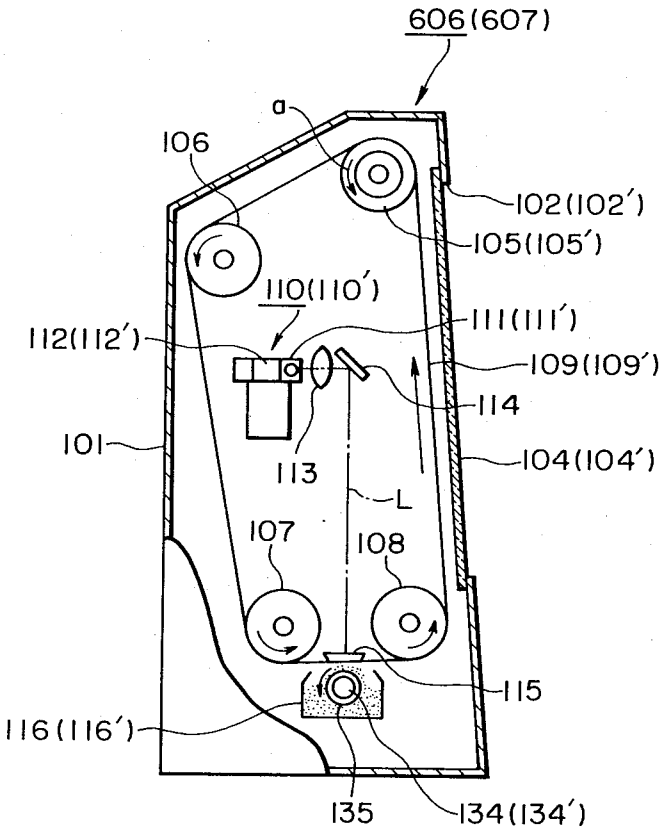
FIG. 22 is a cross-sectional view showing another embodiment of the present invention having two display stations.

FIG. 22 shows still another embodiment of the present invention, which is provided with two display units 606, 607 connected to a microcomputer 1 and arranged side by side. The second display unit 607 is constructed in the same manner as the first display unit 606. Components of the second unit similar to those of the first unit are represented by the same primed numbers.

Figure 23:
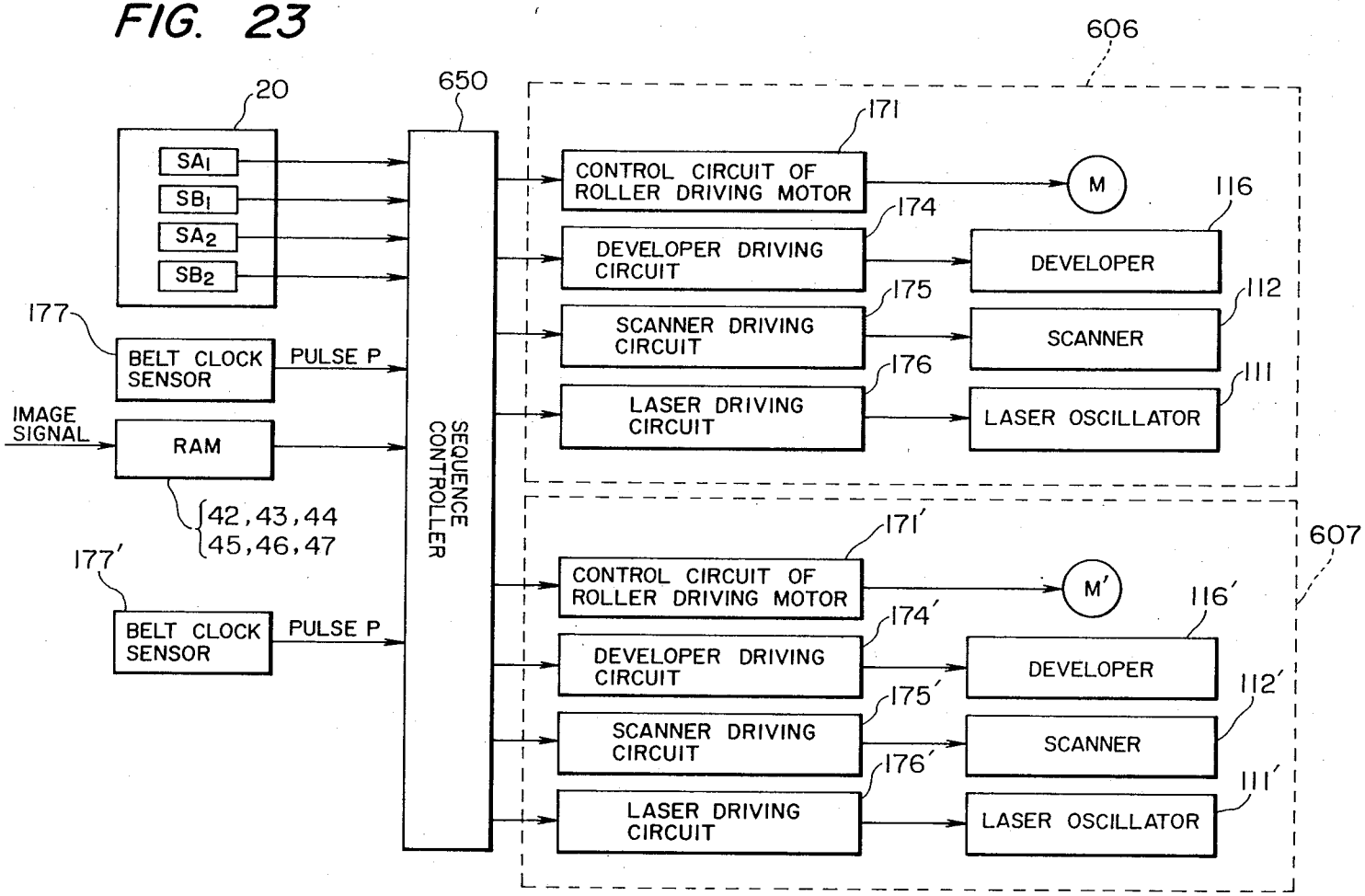
FIG. 23 is a block diagram of a control circuit of the apparatus shown in FIG. 22.

FIG. 23 shows an embodiment of the control unit for use in the apparatus shown in FIG. 22, wherein a sequence controller 650, composed of the CPU 501 shown in FIG. 2, identifies the instructions of the operator such as the designation of the image to be displayed or the start of display operation from the input signals through the keyboard 20 and controls the corresponding functions. The keyboard 20 is provided with a switch SA1 for displaying a new image on the first display unit 606, a switch SB1 for displaying the previously displayed image on the first display unit 606, a switch SA2 for displaying a new image on the second display unit 607, and a switch SB2 for displaying the previously displayed image on the second display unit 607. The switch SA1 has a function to form a new image on the belt 109 of the first display unit 606 by changing an image already formed thereon, and to instruct a selected RAM to store a new image to be displayed next. The switch SB1 has a function to change the image formed on the belt 109 and to form the previously displayed image thereon.

The switch SA2 has a function to form a new image on the belt 109' of the second display unit 607 by changing the previously formed image thereon, and to instruct a selected RAM to store the new image to be displayed next. The switch SB2 has a function to change the image formed on the belt 109' and to form the previously displayed image thereon.

There are further provided a control circuit 171 for a motor M for rotating a roller 105 which drives the belt 109 of the first display unit 606; a developer driving circuit 174 for driving the developer motor of a developing unit 116 and to supply a DC developing voltage of +200 to +300 V thereto; a driving circuit 175 for driving a scanner 112; a driving circuit 176 for driving a laser 111; and a belt clock sensor 177 composed for example of a photoencoder mounted directly on the shaft of the driving roller 105 and adapted to generate a pulse P for each rotation of the driving roller by a predetermined angle, i.e. for each movement of the belt 109 by a predetermined length. The controller 650 measures the amount of movement of the belt by counting said pulses, thus controlling the movement of said belt.

The scanner driving circuit 175 drives the scanner 112 which deflects the laser beam from the laser 111 into the main scanning direction. The laser driving circuit 176 controls the laser 111 to modulate the laser beam according to the image signals.

There are further provided a control circuit 171' for a motor M' for rotating a roller 105' which drives the belt 109' of the second display unit 607; a developer driving circuit 174' for driving the developer motor of a developing unit 116' and to supply a DC developing voltage of +200 to +300 V thereto; a driving circuit 175' for driving a scanner 112'; a driving circuit 176' for driving a laser 111'; and a belt clock sensor 177' composed for example of a photoencoder mounted directly on the shaft of the driving roller 105' and adapted to generate a pulse P for each rotation of the driving roller by a predetermined angle, i.e. for each movement of the belt 109 by a predetermined length. The controller 650 measures the amount of movement of the belt by counting said pulses, thus controlling the movement of said belt.

The scanner driving circuit 175' drives the scanner 112' which deflects the laser beam from the laser 111' into the main scanning direction. The laser driving circuit 176' controls the laser 111' to modulate the laser beam according to the image signals.

Figure 24:
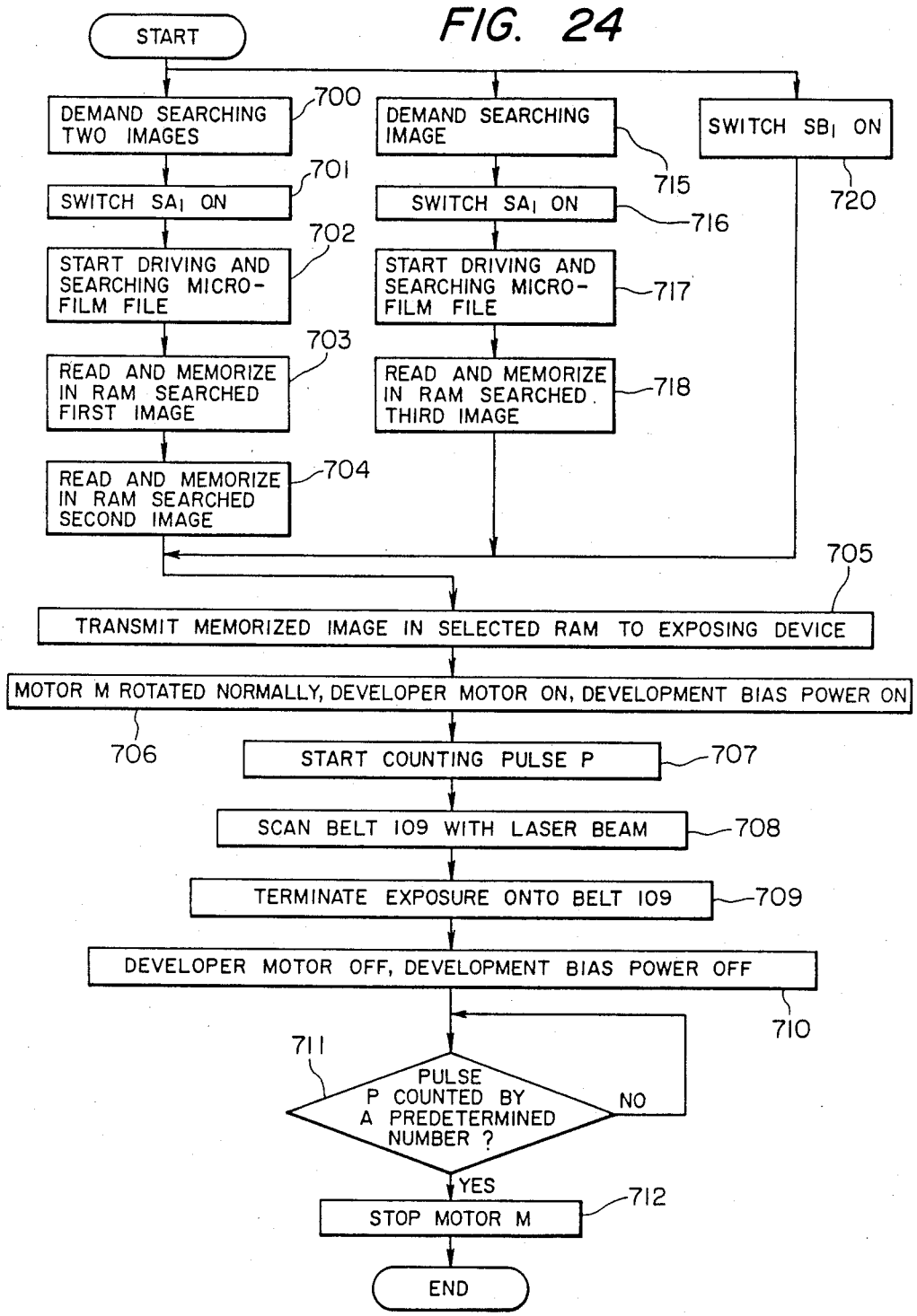
FIGS. 24 and 25 are flow charts showing an example of the function of said control circuit.
Figure 25:
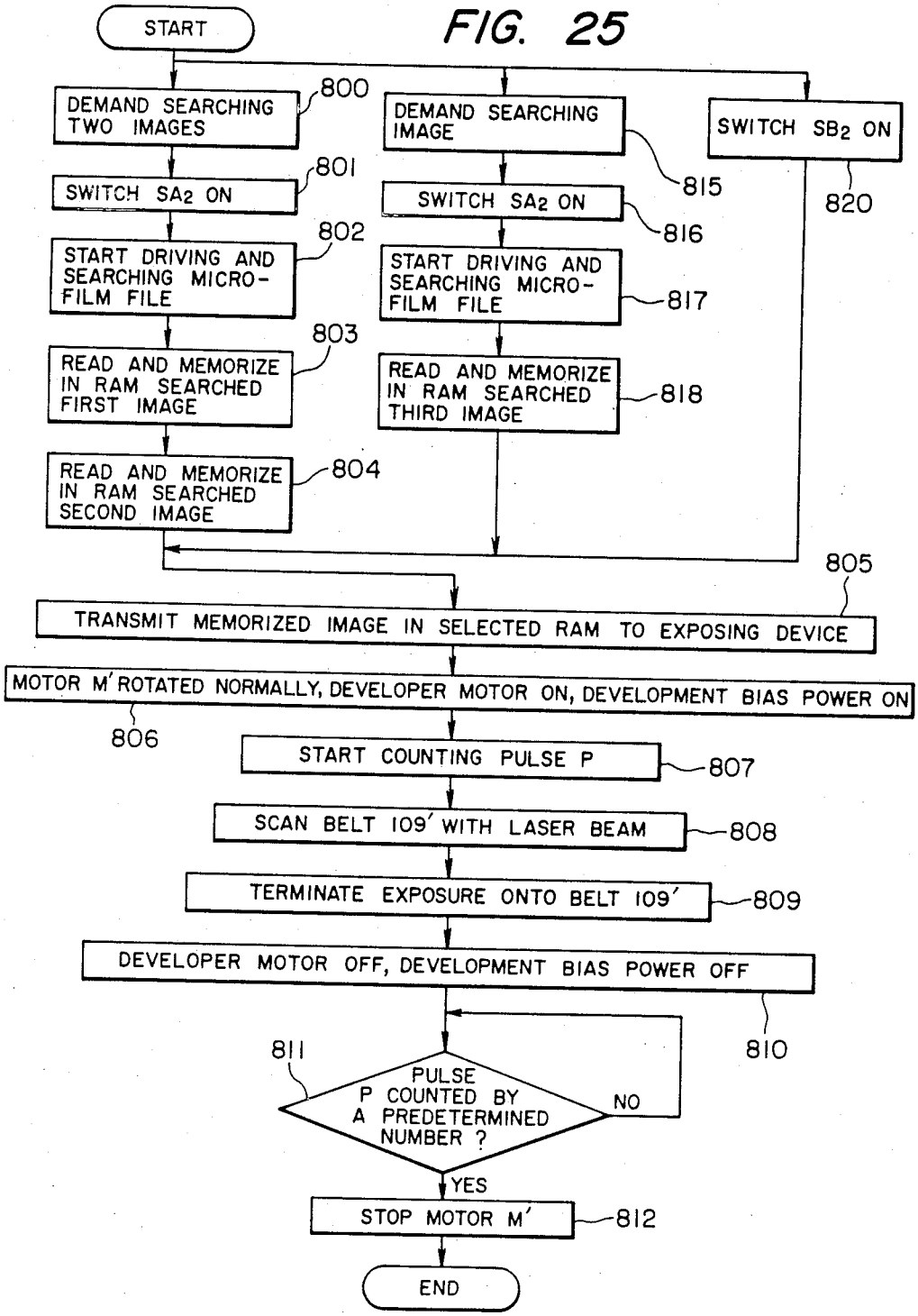

FIG. 24 shows the flow of the functions of the first display unit 606 in response to an image display instruction, and FIG. 25 shows the flow of the functions of the second display unit 607. In the following there will be explained the function in case of displaying images on the first and second display units.

In case of displaying a predetermined image on the first display unit 606, addresses of two images A, B to be displayed are entered into the keyboard 20 for retrieval in the microfilm file 5 (step 700), and the switch SA1 of the keyboard 20 is actuated to instruct the image display (step 701), whereby the microfilm file is activated to start the retrieving operation (step 702). In this manner a first desired image A in the microfilm file 5 is retrieved, read by an image sensor 68 and stored in a RAM 42 (step 703). After the reading and storage of the first image A, a second desired image B is retrieved, read by the image sensor 68 and stored in a RAM 43 (step 704).

After the storage of the first image A, the image signals stored in the RAM 42 are supplied to an exposure unit 110 (step 705). Also the motor M is activated to rotate the roller 105 in a direction a thus moving the belt 109, then the developer motor is activated to rotate magnets 134 and the developing bias voltage is supplied to the developing unit 116 (step 706). In response to the movement of the belt 109 there is initiated the counting of the pulses P (step 707), and the laser beam starts to scan the belt 109 (step 708), with the modulation by the image signals of the first image A stored in the RAM 42. The steps 704, 705 are simultaneously executed, and the display of the first image can be executed during the retrieval and reading of the second image.

When the recording of image signals of an image onto the belt 109 is completed (step 709), the developer motor and the developing bias voltage are turned off in response to the passing of the trailing edge of the exposed area of the belt 109 (step 710). Upon arrival of the count of pulses P at a predetermined value (step 711), the motor M is stopped (step 712) to terminate the movement of the belt 109. In this state the first image A formed on the belt 109 is positioned at the display window 102 to enable the operator to observe the first image A in the first display unit 606.

For displaying desired images on the second display unit 607, addresses of two images A', B' to be displayed are entered into the keyboard 20 for instructing a retrieving operation in the microfilm file 5 (step 800), and the switch SA2 of the keyboard 20 is actuated to instruct an image display (step 801), whereby the microfilm file 5 is activated to start the retrieving operation (step 802). In this manner a first desired image A' in the microfilm file 5 is retrieved, read by an image sensor 68 and stored in a RAM 45. (step 803). After the reading and storage of the first image A', a second desired image B' is retrieved, read by the image sensor 68 and stored in a RAM 46 (step 804).

After the storage of the first image A', the image signals stored in the RAM 45 are supplied to an exposure unit 110' (step 805). Also the motor M' is activated to rotate the roller 105' for moving the belt 109', then the developer motor is activated to rotate magnets 134', and the developing bias voltage is supplied to the developing unit 116' (step 806). In response to the movement of the belt 109' there is initiated the counting of the pulses P (step 807), and the laser beam starts to scan the belt 109' (step 808), with the modulation by the image signals of the first image A' stored in the RAM 45. The steps 804, 805 are simultaneously executed.

When the recording of image signals of an image onto the belt 109' is completed (step 809), the developer motor and the developing bias voltage are turned off in response to the passing of the rear end of the exposed area of the belt 109' (step 810). Upon arrival of the count of pulses P at a predetermined value (step 811), the motor M' is stopped (step 812) to terminate the movement of the belt 109'. In this state the first image A' formed on the belt 109' is positioned at the display window 102' to enable the operator to observe the first image A' in the second display unit 607.

It is now assumed that the first and second images A, B displayed on the first display unit 606 are respectively first and second pages of explanation and the first and second images A', B' displayed on the second display unit 607 are respectively first and second pages of drawings corresponding to said explanation. Consequently the first and second pages of said explanation are respectively stored in the RAMs 42, 43, and the first and second pages of corresponding drawings are respectively stored in the RAMs 45, 46.

In case of displaying the second page B of the explanation after observing the first page A on the first display unit 606, the address of a third image C (third page of the explanation) to be displayed next is entered into the keyboard 20 (step 715) to instruct a retrieving operation in the microfilm file 5 (step 715), and the switch SA1 of the keyboard 20 is actuated to instruct the start of a display operation (step 716), whereby the microfilm file 5 is activated to initiate the retrieving operation (step 717). In this manner the third image C of the third page of the explanation is retrieved in the microfilm file 5, read by the image sensor 68 and stored in the RAM 44 (step 718).

In the course of retrieving and reading the third page C of said explanation, the image signals stored in the RAM 43 are supplied to the exposure unit 110 (step 705). In the following there are executed the steps 706–712 to activate the motor M, to record the image B of the second page of the explanation stored in the RAM 43 onto the belt 109 by the laser beam and to stop the belt 109 when said image B formed thereon is positioned at the display window 102. The steps 717 and 705 are simultaneously executed.

The previously displayed image A of the first page of the explanation is erased by the developing brush in the developing unit 116 in the course of movement of the belt in the direction indicated by the arrow, and a new toner image is formed immediately thereafter by new exposure and development.

In case observation of the previously displayed image A of the first page is desired, there is actuated the switch SB1, thereby the corresponding image signals stored in the RAM 42 are supplied to the exposure unit 110 (step 705), and said image A of the first page is formed on the belt and displayed through the steps 706–712.

If the switch SB1 is actuated after the second observation of the image of the first page, the image signals of the previously displayed second page stored in the RAM 43 are supplied to the exposure unit 110 to again display said image B of the second page. In this manner the previously displayed image can be displayed again by the actuation of the switch SB1. Consequently two consecutive images can be alternately displayed within a short time by repeatedly actuating the switch SB1.

Then, in case of displaying the image C of the third page of the explanation after the display of the image B of the second page on the first display unit 606, address of an image D of the fourth page of the explanation to be displayed next is entered into the keyboard 20 (step 715) to instruct the retrieving operation in the microfilm file 5, and the switch SA1 of the keyboard 20 is actuated (step 716), whereby the microfilm file 5 is activated. Thus the image D of the fourth page is retrieved in the microfilm file, read by the image sensor 68 and stored in the RAM 42 (step 718). Consequently the content of the RAM 42 is changed. In the course of the retrieving and reading of the fourth page, the image signals of the third page to be displayed next are supplied to the exposure unit 110 (step 705), and said image of the third page is displayed through the steps 706–712. Thus, through the steps 715–712 after the observation of the displayed image of the third page, the RAMs 42–44 respectively store the previously displayed image, the presently displayed image and a new image to be displayed next. Consequently a selective actuation of the switches SA1, SB1 allows to selective display of the previously displayed image, presently displayed image or new image within a short time. Then, in case of displaying, in the second display unit 607, the image B′ of a second page of the drawings after the observation of the image A′ of the first page of the drawings, the address of the image C′ to be displayed next of the third page of the drawings is entered into the keyboard 20 to instruct the retrieving operation in the microfilm file (step 815), and the switch SA2 of the keyboard 20 is actuated to start the display operation (step 816), whereby the microfilm file 5 is activated to initiate the retrieving operation (step 817). In this manner the desired image C′ of the third page of the drawings is retrieved in the microfilm file 5, read by the image sensor 68 and stored in the RAM 47 (step 818).

In the course of the retrieving and reading of the image C′ of the third page of the drawings the image signals stored in the RAM 46 are supplied to the exposure unit 110′ (step 805), and there are executed the steps 806–812 to drive the motor M′, to record the image B′ of the second page of the drawings stored in the RAM 46 onto the belt 109′ by the laser beam, and to stop the belt when said image B′ of the second page of the drawings formed thereon is brought to the display window 102′.

The previously displayed image A′ of the first page of the drawings is revomed by the developing brush in the developing unit 116′ in the course of movement of the belt, and a new toner image is formed immediately thereafter by new exposure and development.

In case of thereafter observing the previously displayed image A′ of the first page of the drawings, the switch SB2 is actuated, whereby the image signals of said first page stored in the RAM 45 are supplied to the exposure unit 110′ (step 805) and said image A′ of the first page is formed on the belt and displayed again through the steps 806–812.

In case the switch SB2 is again actuated (step 820) after the second observation of the image of the first page, the image signals of the previously displayed second page stored in the RAM 46 are supplied to the exposure unit 110′ to display said image B′ of the second page is displayed again. In this manner the switch SB2 causes repeated display of a previously displayed image.

In case of displaying the image C′ of the third page of the drawings after the observation of the image B′ of the second page on the second display unit 607, the address of an image D′ to be displayed nest of a fourth page of the drawings is entered into the keyboard 20 (step 815) to instruct the retrieving operation of the micorfilm file 5, and the switch SA2 of the keyboard 20 is actuated (step 816) whereby the microfilm file 5 is activated to effect the retrieving operation. In this manner the image D′ of the fourth page of the drawings is retrieved in the microfilm file, read by the image sensor 68, and stored in the RAM 45 (step 818). Consequently the content of said RAM 45 is changed. In the course of the retrieving and reading of the image D′ of the fourth page, the image signals of the third page stored in the RAM 47 are supplied to the exposure unit 110′ (step 805), and the image C′ of said third page is displayed through the steps 806–812. Through the repeated steps of 815-812 after the observation of the third page, the RAMs 45–47 respectively store the previously stored image, presently displayed image and a new image to be displayed next. Consequently the selective actuation of the switches SA2, SB2 allows selective display of the previously displayed image, presently displayed image and new image.

As explained in the foregoing, simultaneous display of two images on the first and second display units 606, 607 allows observation of said image with mutual reference. Also the preceding and succeeding images can be displayed within a short time, and it is therefore rendered possible to observe and examine many mutually related images in an efficient manner.

The RAMs 42–47 need not necessarily store the images in the order of pages, but may store arbitrarily images to be displayed in succession. In case an image to be displayed next is absent at the display of a new image, the step 715 or 815 is skipped and the switch SA1 or SA2 is actuated in the step 716 or 816. In such case the steps 717, 718 or 817, 818 are skipped and the microfilm file is not activated.

In the foregoing embodiments the images retrieved from the microfilm file 5 are displayed in succession, but it is also possible to display, in similar manner, the images retrieved from the image file 4. It is furthermore possible to display three or more images simultaneously by means of three or more display units.

In the foregoing embodiment the belts 109, 109′ are driven only in the forward direction, but they may be driven bidirectionally by reversing the motors M, M′.

As explained in the foregoing, the present invention allows simultaneous display of plural related images, thus enabling mutual reference to be made between the display images. Also preceding and succeeding images can be displayed in a short time, so that efficient observation and investigation of many images can be achieved.

It is to be noted that the embodiment shown in FIG. 22 may employ only one display unit shown in FIGS. 4 or 14.

What is claimed is:

1. A display apparatus for displaying images formed on an image bearing member, comprising:

a plurality of image bearing members;

holding means for holding the image bearing members in a movable condition;

image forming means for forming a plurality of images on the image bearing members;

display means for simultaneously displaying said plurality of images formed on the image bearing members at an observation position;

a plurality of erasing means each corresponding to a respective image bearing member for erasing at least one of said plurality of images on the respective image bearing member;

drive means for independently moving each of said image bearing members through said image forming means, said display means and said erasing means; and erasure control means for controlling said erasing means such that an image selected from the plurality of images formed on the image bearing members, and simultaneously displayed at the observation position, is erased by said erasing means.

2. A display apparatus according to claim 1, wherein each of said image bearing members has an endless form which is adapted to move along a circulating path, and said image forming means, said display means and said erasing means are arranged along said image bearing members.

3. A display apparatus according to claim !, wherein each of the image bearing members is composed of a material capable of recording and erasing images, and is used for image recording in said image forming means, then moved to said display means for image display, then further moved to said erasing means for image erasure and then still further moved to said image forming means for repeated image recording use.

4. A display apparatus according to claim 3, wherein each of said image bearing members comprises an electrophotographic photosensitive member, and said image forming means comprises sensitizing means for forming a latent image on said photosensitive member and developing means for developing said latent image formed on said photosensitive member with a developing agent.

5. A display apparatus according to claim 4, wherein each of said erasing means comprises means for cleaning said photosensitive member.

6. A display apparatus according to claim 4, wherein said image forming means is adapted to expose said photosensitive member to light modulated according to image signals.

7. A display apparatus according to claim 4, wherein each of said photosensitive members is formed in a belt and wherein said sensitizing means is located at one surface of said photosensitive member, and said developing means is located at the other surface of the photosensitive member.

8. A display apparatus according to claim 7, wherein each of said photosensitive members is divided into plural areas in a direction perpendicular to the moving direction of said photosensitive member, wherein each area is selectively exposed.

9. A display apparatus according to claim 4, wherein said developing means comprises brush developing means for applying a magnetic brush to a selected area of the photosensitive member.

10. A display apparatus according to claim 9, wherein said developing means also serves as said erasing means for erasing said image by removing the developing agent attached to the photosensitive members with the magnetic brush.

11. A display apparatus according to claim 1, wherein each of said image bearing members is divided into plural areas in a direction perpendicular to the moving direction of said photosensitive member, and each area is adapted to selectively form an image.

12. A display apparatus according to claim 1, wherein said image forming means is adapted to form a visible image by depositing developer onto the image bearing member, and said erasing means is adapted to erase the image by wiping the developer deposited on said image bearing member.

13. A display apparatus according to claim 1, wherein each of said image bearing members is composed of a material showing a color change by heating.

14. A display apparatus according to claim 1, wherein each of said image bearing members is composed of an insulation material.

15. A display apparatus according to claim 1, further comprising designating means for designating images to be erased among plural images displayed at the observation position of said display means, wherein thus designated images are erased in an erasing position of said erasing means.

16. A display apparatus for displaying images formed on an image bearing member, comprising:

a plurality of movable image bearing members;

image forming means for forming erasable images on said image bearing members;

display means for simultaneously displaying the images formed on said image bearing members at an observation position;

erasing means for erasing the images formed on said image bearing members;

drive means for independently moving each of said image bearing members through said image forming means, said display means and said erasing means; and drive control means for selectively moving one of said plurality of movable image bearing members through said erasing means, wherein a selected image formed on said one of said plurality of movable image bearing members, and simultaneously displayed at the observation position, is erased.

17. A display apparatus according to claim 16, wherein said plural image bearing members are arranged adjacent to each other and movable in the same direction, and wherein said image forming means and said erasing means comprise a plurality of image forming means and a plurality of erasing means, respectively, corresponding to each of said image bearing members.

18. A display apparatus according to claim 16, wherein said image forming means comprises means for applying a coloring agent to the image bearing members.

19. A display apparatus according to claim 16, wherein said image bearing members include a material whose color changes in dependence on heat, and wherein said image forming means comprises heating means for heating said image bearing members in accordance with an image signal.

20. A display apparatus according to claim 16, wherein each of said image bearing members comprises a photosensitive member, and wherein said image forming means comprises means for exposing said photosensitive member.

21. A display apparatus for displaying images formed on an image bearing member, comprising:

a plurality of image bearing members;

reader means for reading an image on an original and for converting the read information into an electric image signal;

memory means for storing a plurality of said electric image signals corresponding to a plurality of originals read by said reader means;

image forming means responsive to said image signals stored in said memory means for forming a plurality of erasable images on the image bearing members;

display means for simultaneously displaying said plurality of images formed on the image bearing members at a display position;

a plurality of erasing means each corresponding to a respective image bearing member for erasing an image formed on the respective image bearing member;

drive means for independently moving each of said image bearing members through said image forming means, said display means and said erasing means;

designating means for designating one of said plurality of images formed on the image bearing members and simultaneously displayed at said display position;

erasure control means, responsive to said designating means, for selectively erasing the image designated by said designating means, and for preventing erasure of a non-designated image simultaneously displayed on said image bearing members; and image formation control means, responsive to said designating means, for controlling said memory means, such that said memory means supplies a substitution image to said image forming means thereby forming said substitution image on one of the image bearing members and displaying said substitution image at said display position.

22. A display apparatus according to claim 21, wherein said memory means is adapted to store a previously displayed image, a currently displayed image and an image to be displayed next.

23. A display apparatus for displaying images formed on a movable image bearing member, comprising:

a plurality of image bearing members;

drive means for independently moving each of said image bearing members between a display position and a non-display position;

image forming means for sectioning each of the image bearing members into a plurality of areas and forming an erasable image on each sectioned area, said image forming means being disposed at the non-display position and selectively forming the images on the plurality of sectioned areas;

display means for displaying the images formed on the image bearing members at a display position, said display means having a display window allowing the images formed on the sectioned areas on the image bearing members to be simultaneously observed therethrough;

a plurality of erasing means each corresponding to a respective image bearing member, disposed at the non-display position, for erasing the images formed on the respective image bearing member; and erasure control means for controlling said drive means and said erasing means, such that an image formed on a selected one of said plurality of sectioned areas of the image bearing member displayed in the display window is erased, and such that erasure of images formed on sectioned areas other than the selected one is prevented.

24. A display apparatus according to claim 23, wherein each of said image bearing members has an endless form which is adapted to move along a circulating path, and said image forming means, said display means and said erasing means are arranged along said image bearing members.

25. A display apparatus according to claim 23, wherein said erasing means is movable between a first position where it effects the erasure of an image formed on the image bearing member and a second position where it does not effect erasure.

* * * * *

UNITED STATES PATENT AND TRADEMARK OFFICE

CERTIFICATE OF CORRECTION

PATENT NO. : 4,720,707

DATED : January 19, 1988

INVENTOR(S) : MOTOFUMI KONISHI, ET AL.

It is certified that error appears in the above-identified patent and that said Letters Patent is hereby corrected as shown below:

[56] REFERENCES CITED

Line 3, 2,421,902 5/1949 Ruth ..... 340/809X" should read --2,471,902 5/1949 Rufle ..... 340/809X--.

Line 5, "Diddons" should read --Diddens--.

COLUMN 1

Line 67, "two image" should read --two images--.

COLUMN 4

Line 26, "Motolora 68000);" should read --Motorola 68000);--.

COLUMN 5

Line 64, "abovedescribed" should read --above-described--.

COLUMN 6

Line 60, "anticlockwise" should read --counterclockwise--.

Line 61, "anti-" should read --counter--.

COLUMN 8

Line 48, "particular" should read --particulate--.

UNITED STATES PATENT AND TRADEMARK OFFICE

CERTIFICATE OF CORRECTION

PATENT NO. : 4,720,707

DATED : January 19, 1988

INVENTOR(S) : MOTOFUMI KONISHI, ET AL.

It is certified that error appears in the above-identified patent and that said Letters Patent is hereby corrected as shown below:

COLUMN 11
Line 57, "it" should read --but it--.

COLUMN 12
Line 47, "to" should be deleted.

COLUMN 13
Line 30, "counter-clockwise" should read --counterclockwise--.

COLUMN 14
Line 24, "are," should read --is,--.
Line 26, "FIG. 14" should read --FIG. 17--.
Lines 52-53, "laser 176;" should read --laser 111;--.

COLUMN 15
Line 44, "enge" should read --edge--.

COLUMN 17
Line 36, "exposure unit 111" should read --exposure unit 110--.
Line 65, "the same" should be deleted.

UNITED STATES PATENT AND TRADEMARK OFFICE

CERTIFICATE OF CORRECTION

PATENT NO. : 4,720,707

DATED : January 19, 1988

INVENTOR(S) : MOTOFUMI KONISHI, ET AL.

It is certified that error appears in the above-identified patent and that said Letters Patent is hereby corrected as shown below:

COLUMN 18
Line 58, "belt 109" should read --belt 109'--.

COLUMN 19
Line 10, "file" should read --file 5--.

COLUMN 20
Line 4, "rear end" should read --trailing edge--.

COLUMN 21
Line 20, "to" should be deleted.
Line 47, "revomed" should read --removed--.
Line 62, "to display" should read --so that--.
Line 68, "nest" should read --next--.

COLUMN 22
Line 2, "micorfilm" should read --microfilm--.
Line 24, "image" should read --images--.

COLUMN 23
Line 18, claim !," should read --claim 1,--.
Line 35, "each of" should be deleted.

UNITED STATES PATENT AND TRADEMARK OFFICE

CERTIFICATE OF CORRECTION

PATENT NO. : 4,720,707

DATED : January 19, 1988

INVENTOR(S) : Motofumi Konishi, et al

It is certified that error appears in the above-identified patent and that said Letters Patent is hereby corrected as shown below:

COLUMN 23

Line 50, "member," should read --members,--.

Signed and Sealed this

Eighth Day of November, 1988

*Attest:*

DONALD J. QUIGG

*Attesting Officer*

*Commissioner of Patents and Trademarks*